US005342749A

United States Patent [19]

Sakanoue et al.

[11] Patent Number: 5,342,749

[45] Date of Patent: Aug. 30, 1994

[54] SILVER HALIDE COLOR PHOTOGRAPHIC MATERIALS

[75] Inventors: Kei Sakanoue; Keizo Kimura, both of Kanagawa, Japan

[73] Assignee: Fuji Photo Film Co., Ltd., Kanagawa, Japan

[21] Appl. No.: 170,632

[22] Filed: Dec. 21, 1993

Related U.S. Application Data

[63] Continuation of Ser. No. 796,358, Nov. 22, 1991, abandoned.

[30] Foreign Application Priority Data

Nov. 22, 1990 [JP] Japan ..... 2-319738

[51] Int. Cl.[5] ..... G03C 7/38

[52] U.S. Cl. ..... 430/558; 430/386; 430/387

[58] Field of Search ..... 430/558, 386, 387

[56] References Cited

U.S. PATENT DOCUMENTS 4,873,183 10/1989 Tachibana et al. ..... 430/558

FOREIGN PATENT DOCUMENTS 0182486 5/1986 European Pat. Off. .
0226849 7/1987 European Pat. Off. .
0143570 6/1985 Japan ..... 430/558
3024256 2/1988 Japan ..... 430/558

*Primary Examiner*—Lee C. Wright
*Attorney, Agent, or Firm*—Sughrue, Mion, Zinn, Macpeak & Seas

[57] ABSTRACT

A silver halide color photographic material comprising a support having thereon at least one silver halide emulsion layer and containing a 1H-pyrazolo[5,1-c]-1,2,4-triazole couplers represented by the general formula (I) of the general formula (II):

(I)

(II)

wherein A represents a group which is bonded to L via the benzene ring or a carbon atom in $R^{12}$ on the benzene ring which is the substituent group in the 3-position of the 1H-pyrazolo[5,1-c]-1,2,4-triazole parent nucleus represented by general formula (III) below;

(III)

3 Claims, No Drawings

SILVER HALIDE COLOR PHOTOGRAPHIC MATERIALS

This is a continuation of application Ser. No. 07/796,358 filed Nov. 22, 1991, now abandoned.

FIELD OF THE INVENTION

This invention concerns silver halide color photographic materials which contain novel pyrazoloazole based magenta couplers which have improved resistance to light.

BACKGROUND OF THE INVENTION

The formation of color photographic images based on the subtractive color method is generally carried out by subjecting a silver halide color photographic material to color development processing using a primary aromatic amine based developing agent in the presence of cyan, magenta and yellow couplers. At this time, the exposed silver halide grains in the color photographic material are reduced by the developing agent and the oxidation products of the developing agent which are produced at the same time undergo a coupling reaction with the couplers to form cyan, magenta and yellow dyes respectively and these form the color photographic image.

5-Pyrazolones in particular have been employed conventionally for magenta couplers of these couplers. However, these couplers have absorptions which are undesired from a color reproduction point of view, and there is a major problem in improving color reproduction of the red system in particular. Most recently, the pyrazolobenzimidazole skeleton disclosed in British Patent 1,047,612, the indazolone skeleton disclosed in U.S. Pat. No. 3,770,447 and the 1H-pyrazolo[5,1-c]-1,2,4-triazole skeleton disclosed in U.S. Pat. No. 3,725,067 have been disclosed as magenta colored image forming skeletons where this unwanted subsidiary absorption is small. Moreover, the imidazopyrazole skeleton disclosed in U.S. Pat. No. 4,500,630 and the 1H-pyrazolo[1,5-b]-1,2,4-triazole skeleton disclosed in U.S. Pat. No. 4,540,654 have also been suggested.

In particular, couplers with a 1H-pyrazolo[5,1-c]-1,2,4-triazole skeleton or a 1H-pyrazolo[1,5-b]-1,2,4-triazole skeleton have an excellent hue and excellent color forming properties and they have already become practical in some products.

Of couplers with a 1H-pyrazolo[5,1-c]-1,2,4-triazole skeleton which have an improved hue, the couplers disclosed in U.S. Pat. No. 4,942,117 have an excellent hue and the disclosure is that the graininess and photographic speed, which are weaknesses of couplers which have the same parent nucleus, approach those of the 5-pyrazolone type couplers and that they have a performance which is satisfactory for practical use.

However, the couplers disclosed in this patent have a poor fastness to light and they are not sufficiently stable for use in color photosensitive materials for print purposes or for slide purposes. The combined use of anti-color fading agents has been employed as a means of improving this aspect of these couplers. This method provides some improvement if an appropriate anti-fading agent is selected, but it is necessary to add a large amount of anti-fading agent with respect to the coupler to provide an adequate effect. The oil soluble component is increased as the amount added is increased and so this ultimately results in an increase of the emulsion film thickness. An increase in the emulsion film thickness results in a decrease in the sharpness of a color photosensitive material, especially with camera materials, and results in a worsening of picture quality. Furthermore, an increase in emulsion film thickness retards the progress of the development of the emulsion layer on the side closest to the support and so impedes any decrease in the development time.

SUMMARY OF THE INVENTION

Hence, an object of this present invention is to provide an improvement in light fastness without increasing the oil soluble component when using 1H-pyrazolo[5,1-c]-1,2,4-triazole based magenta couplers.

As a result of various investigations, the inventors have found that the problems described above can be resolved by the means indicated below.

That is to say, the present invention provides a silver halide color photographic material containing a 1H-pyrazolo[5,1-c]-1,2,4-triazole coupler represented by the general formula (I) or the general formula (II).

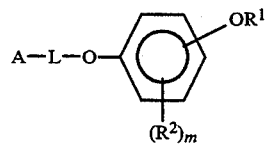

(I)

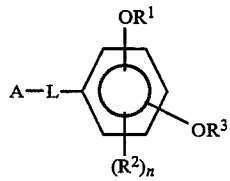

(II)

In these formulae, A represents a group which is bonded to L via the benzene ring or a carbon atom in $R^{12}$ on the benzene ring which is the substituent group in the 3-position of the 1H-pyrazolo[5,1-c]-1,2,4-triazole parent nucleus represented by general formula (III) below, which has total carbon atoms of 11 to 50, preferably 11 to 25. L represents a divalent linking group which has at least 1 carbon atom, preferably 1 to 60, most preferably 2 to 30 carbon atoms.

$R^1$ and $R^3$ represent substituted or unsubstituted alkyl groups, alkenyl groups or aryl groups. $R^2$ represents a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group. m represents an integer of from 0 to 4, and n represents an integer of from 0 to 3. In those cases where m and n are 2 or more, the $R^2$ groups may be the same or different.

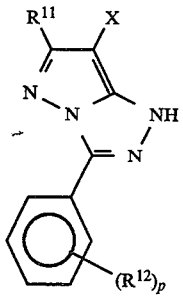

(III)

In this formula, the $R^{11}$ and $R^{12}$ groups may be the same or different, and each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group, and X represents a substituent group which is eliminated after the coupling reaction with the oxidation products of a primary aromatic amine developing agent. Moreover, p represents an integer of from 0 to 5, and when p is 2 or more, the $R^{12}$groups may be the same or different. Oligomers where at least dimers are formed via $R^1$, $R^2$, $R^3$, $R^{11}$, $R^{12}$ or X are also included in the scope of the present invention.

DETAILED DESCRIPTION OF THE INVENTION

Compounds which can be used in the present invention are described in detail below. In general formula (I) or (II), $R^1$ and $R^3$represent substituted or unsubstituted alkyl groups, alkenyl groups or aryl groups having a carbon number of 1 t 40, preferably 1 to 20. More specifically, $R^1$ represents an alkyl group (for example, methyl, ethyl, n-propyl, isopropyl, n-butyl, sec-butyl, tert-butyl, n-pentyl, tert-amyl, n-hexyl, tert-hexyl, octyl, tert-octyl, 2-ethylhexyl, n-decyl, n-dodecyl, 2-bromoethyl, 3-bromopropyl, 4-bromobutyl, 2-chloroethyl, 3-chloropropyl, 4-chlorobutyl, 2-methoxyethyl, 2-ethoxyethyl, 2-butoxyethyl, 2-(2-methoxyethoxy)ethyl, 2-phenoxyethyl, 2-methoxypropyl, 1-ethoxycarbonyl-1-pentyl, 3-(2,4-di-tert-amylphenoxy)propyl, 4-methanesulfonamidobutyl, 2-methanesulfonylethyl, 2,2,2-trifluoroethyl), an aryl group (for example, phenyl, 4-methoxyphenyl, 2-methoxyphenyl, 2,6-dichlorophenyl, 4-tert-octylphenyl, 2,4-di-tert-amylphenyl, 4-methanesulfonamidophenyl, 4-methanesulfonylphenyl, 4-ethoxycarbonylphenyl, 4-carboxyphenyl, p-tolyl, 4-ethylphenyl, 4-biphenyl, 1-naphthyl, 2-naphthyl) or an alkenyl group (for example, vinyl, allyl, crotyl, 3-methyl-2-buten-1-yl, 10-undecenyl, citronelyl), The substituent represented by $R^2$ in general formulae (I) and (II) is a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group, having a carbon number of 1 to 60, preferably 1 to 30, m represents an integer of from 0 to 4, and n represents an integer of from 0 to 3. In those cases where m and n are 2 or more, the $R^2$ groups may be the same or different.

Furthermore, in those cases where $R^2$ is bonded to a position adjacent to —$OR^1$ or —$OR^3$, $R^2$ may be bonded to $R^1$ or $R^3$ to form a five to seven membered ring. More specifically, $R^2$ represents a halogen atom (for example, chlorine, bromine), an alkyl group (for example, methyl, propyl, tert-butyl, trifluoromethyl, tridecyl, 3-(2,4-di-tert-amylphenoxy)propyl, allyl, 2-dodecyloxyethyl, 3-phenoxypropyl, 2-hexylsulfonylethyl, cyclopentyl, benzyl, 2-ethylhexyl, tert-hexyl, tert-octyl), an aryl group (for example, phenyl, 4-tert-butylphenyl, 2,4-di-tert-amylphenyl, 4-tetradecanamidophenyl), a heterocyclic group (for example, 2-furyl, 2-thienyl, 2-pyrimidinyl, 2-benzothiazolyl), a cyano group, an alkoxy group (for example, methoxy, ethoxy, 2-methoxyethoxy, 2-dodecyloxyethoxy, 2-methanesulfonylethoxy), an aryloxy group (for example, phenoxy, 2-methylphenoxy, 4-tert-butylphenoxy), a heterocyclic oxy group (for example, 2-benzimidazolyloxy), an acyloxy group (for example, acetoxy, hexadecanoyloxy), a carbamoyloxy group (for example, N-phenylcarbamoyloxy, N-ethylcarbamoyloxy), a silyloxy group (for example, trimethylsilyloxy), a sulfonyloxy group (for example, dodecylsulfonyloxy), an acylamino group (for example, acetamido, benzamido, tetradecanamido, α-(2,4-di-tert-amylphenoxy)butylamido, γ-(3-tert-butyl-4-hydroxyphenoxy)butylamido, α-{4-(4-hydroxyphenylsulfonyl)phenoxy}decanamido), an anilino group (for example, phenylamino, 2-chloroanilino, 2-chloro-5-tetradecanamidoanilino, 2-chloro-5-dodecyloxycarbonylanilino, N-acetylanilino, 2-chloro-5-{α-(3-tert-butyl-4-hydroxyphenoxy)dodecanamido}anilino), a ureido group (for example, phenylureido, methylureido, N,N-dibutylureido), an imido group (for example, N-succinimido, 3-benzylhydantoinyl, 4-(2-ethylhexylamino)phthalimido), a sulfamoylamino group (for example, N,N-dipropylsulfamoylamino, N-methyl-N-dodecylsulfamoylamino), an alkylthio group (for example, methylthio, octylthio, tetradecylthio, 2-phenoxyethylthio, 3-phenoxypropylthio, 3-(4-tert-butylphenoxy)propylthio), an arylthio group (for example, phenylthio, 2-butoxy-5-tert-octylphenylthio, 3-pentadecylphenylthio, 2-carboxyphenylthio, 4-tetradecanamidophenylthio), a heterocyclic thio group (for example, 2-benzothiazolylthio), an alkoxycarbonylamino group (for example, methoxycarbonylamino, tetradecyloxycarbonylamino), an aryloxycarbonylamino group (for example, phenoxycarbonylamino, 2,4-di-tert-butylphenoxycarbonylamino), a sulfonamido group (for example, methanesulfonamido, hexadecanesulfonamido, benzenesulfonamido, p-toluenesulfonamido, octadecanesulfonamido, 2-methyloxy-5-tert-butylbenzenesulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)propyl}carbamoyl), an acyl group (for example, acetyl, (2,4-di-tert-amylphenoxy)acetyl, benzoyl), a sulfamoyl group (for example N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (for example, methanesulfonyl, octanesulfonyl, benzenesulfonyl, toluenesulfonyl, 2-butoxy-5-tert-octylbenzenesulfonyl), a sulfinyl group (for example, octanesulfinyl, dodecylsulfinyl, phenylsulfinyl), an alkoxycarbonyl group (for example, methoxycarbonyl, butyloxycarbonyl, dodecyloxycarbonyl, octadecyloxycarbonyl) or an aryloxycarbonyl group (for example, phenyloxycarbonyl, 3-pentadecylphenoxycarbonyl).

Actual examples of linking groups represented by L in general formula (I) or (II) include the divalent groups corresponding to the groups other than the halogen atoms and the cyano group of the substituent groups described above in connection with $R^2$. However, these groups contain at least 1 carbon atom.

In general formula (III), $R^{11}$ and $R^{12}$ may be the same or different, and each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group, and X represents a substituent which is eliminated after the coupling reaction, such as a halogen atom, a carboxy group or a group which is bonded to the carbon atom at the coupling position via an oxygen atom, a nitrogen atom or a sulfur atom. Total carbon numbers of $R^{11}$ and $R^{12}$ are 1 to 24, and 1 to 50, preferably 1 to 12 and 1 to 25, respectively.

More specifically, $R^{11}$ and $R^{12}$ each represent a halogen atom (for example chlorine, bromine), an alkyl group (for example, methyl, propyl, tert-butyl, trifluoromethyl, tridecyl, 3-(2,4-di-tert-amylphenoxy)propyl, allyl, 2-dodecyloxyethyl, 3-phenoxypropyl, 2-hexylsulfonylethyl, cyclopentyl, benzyl), an aryl group (for example, phenyl, 4-tert-butylphenyl, 2,4-di-tert-amylphenyl, 4-tetradecanamidophenyl), a heterocyclic group (for example, 2-furyl, 2-thienyl, 2-pyrimidinyl, 2-benzothiazolyl), a cyano group, an alkoxy group (for example, methoxy, ethoxy, 2-methoxyethoxy, 2-dodecyloxyethoxy, 2-methanesulfonylethoxy), an aryloxy group (for example, phenoxy, 2-methylphenoxy, 4-tert-butylphenoxy), a heterocyclic oxy group (for example, 2-benzimidazolyloxy), an acyloxy group (for example, acetoxy, hexadecanoyloxy), a carbamoyloxy group (for example, N-phenylcarbamoyloxy, N-ethylcarbamoyloxy), a silyloxy group (for example, trimethylsilyloxy), a sulfonyloxy group (for example, dodecylsulfonyloxy), an acylamino group (for example, acetamido, benzamido, tetradecanamido, α-(2,4-di-tert-amylphenoxy)butylamido, y-(3-tert-butyl-4-hydroxyphenoxy)butylamido, α-{4-(4-hydroxyphenylsulfonyl)-phenoxy}decanamido), an anilino group (for example, phenylamino, 2-chloroanilino, 2-chloro-5-tetradecanamidoanilino, 2-chloro-5-dodecyloxycarbonylanilino, N-acetylanilino, 2-chloro-5-{α-(3-tert-butyl-4-hydroxyphenoxy)dodecanamido}anilino), a ureido group (for example, phenylureido, methylureido, N,N-dibutylureido), an imido group (for example, N-succinimido, 3-benzylhydantoinyl, 4-(2-ethylhexylamino)phthalimido), a sulfamoylamino group (for example, N,N-dipropylsulfamoylamino, N-methyl-N-decylsulfamoylamino), an alkylthio group (for example, methylthio, octylthio, tetradecylthio, 2-phenoxyethylthio, 3-phenoxypropylthio, 3-(4-tert-butylphenoxy)propylthio, an arylthio group (for example, phenylthio, 2-butoxy-5-tert-octylphenylthio, 3-pentadecylphenylthio, 2-carboxyphenylthio, 4-tetradecanamidophenylthio), a heterocyclic thio group (for example, 2-benzothiazolylthio), an alkoxycarbonylamino group (for example, methoxycarbonylamino, tetradecyloxycarbonylamino), an aryloxycarbonylamino group (for example, phenoxycarbonylamino, 2,4-di-tert-butylphenoxycarbonylamino) , a sulfonamido group (for example, methanesulfonamido, hexadecanesulfonamido, benzenesulfonamido, p-toluenesulfonamido, octadecanesulfonamido, 2-methyloxy-5-tertbutylbenzenesulfonamido), a carbamoyl group (N-ethylcarbamoyl, N,N-dibutylcarbamoyl, N-(2-dodecyloxyethyl) carbamoyl, N-methyl-N-dodecylcarbamoyl, N-{-3-(2,4-di-tert-amylphenoxy)-propyl}carbamoyl), an acyl group (for example, acetyl, (2,4-di-tert-amylphenoxy)acetyl, benzoyl), a sulfamoyl group (for example N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (for example, methanesulfonyl, octanesulfonyl, benzenesulfonyl, toluenesulfonyl), a sulfinyl group (for example, octanesulfinyl, dodecylsulfinyl, phenylsulfinyl), an alkoxycarbonyl group (for example, methoxycarbonyl, butyloxycarbonyl, dodecyloxycarbonyl, octadecyloxycarbonyl) or an aryloxycarbonyl group (for example, phenyloxycarbonyl, 3-pentadecylphenoxycarbonyl), and X represents a halogen atom (for example chlorine, bromine, iodine), a carboxy group or a group which is linked with an oxygen atom, (for example acetoxy, propanoyloxy, benzoyloxy, 2,4-dichlorobenzoyloxy, ethoxyoxazolyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzothiazolyloxy), a group which is linked with a nitrogen atom (for example, benzenesulfonamido, N-ethyltoluenesulfonamido, pentafluorobutanamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzyl-5-ethoxy-3-hydantoinyl, 2N-1,1-dioxo-3-(2H)-oxo-1,2-benzoisothiazolyl, 2-oxo-1,2-dihydro-1-pyridinyl, imidazolyl, pyrazolyl, 3,5-diethyl-1,2,4-triazol-1-yl, 5- or 6-bromobenzotriazol-1-yl, 5-methyl-1,2,3,4-tetrozol-1-yl, benzimidazolyl, 3-benzyl-1-hydantoinyl, 1-benzyl-5-hexadecyloxy-3-hydantoinyl, 5-methyl-1-tetrazolyl), an arylazo group (for example 4-methoxypheylazo, 4-pivaloylaminophenylazo, 2-naphthylazo, 3-methyl-4-hydroxyphenylazo), or a group which is linked with a sulfur atom (for example, phenylthio, 2-carboxyphenylthio, 2-methoxy-5-tert-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio, 2-phenyl-3-dodecyl-1,2,4-triazolyl-5-thio).

Bis-forms can be formed where $R^1$, $R^2$, $R^3$, $R^{11}$ $R^{12}$ or X is a divalent group.

Furthermore, polymer couplers in which coupler residual groups represented by general formula (I) or (II) are present in the main chain of the polymer or in side chains may be formed, and polymers which are derived from vinyl monomers including units which are represented by these general formulae are especially desirable, and in this case $R^1$, $R^2$, $R^3$, $R^{11}$, $R^{12}$ or X represents a vinyl group, or a linking group.

Where a bis-form is formed with $R^1$, $R^2$, $R^3$, $R^{11}$, $R^{12}$ or X being a divalent group, or $R^{11}$ or $R^{12}$ represents a substituted or unsubstituted alkylene group (for example, methylene, ethylene, 1,10-decylene, $—CH_2CH_2—O—CH_2CH_2—$), a substituted or unsubstituted phenylene group (for example, 1,4-phenylene, 1,3-phenylene),

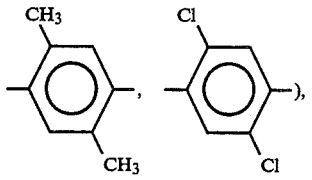

an $—NHCO—R_{13}—CONH—$ group (where $R_{13}$ represents a substituted or unsubstituted alkylene group or phenylene group, for example, $—NHCOCH_2CH_2CONH—$,

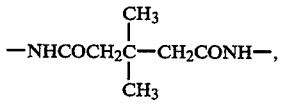

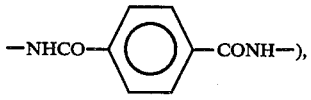

or an $—S—R_{13}—S—$, group (where $R_{13}$ is a substituted or unsubstituted alkylene group, for example $—S—CH_2CH2—S—$,

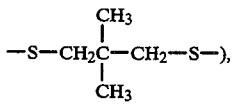

and X represents a divalent group where the above described univalent groups are appropriate.

The linking groups represented by $R^{11}$, $R^{12}$ or X where a group represented by general formula (III) is included in a vinyl monomer include groups which comprise a combination of groups selected from an alkylene group (substituted or unsubstituted alkylene groups, for example methylene, ethylene, 1,10-decylene, $—CH_2CH_2—O—CH_2CH_2—$) a phenylene group (a substituted or unsubstituted phenylene group (for example 1,4-phenylene, 1,3-phenylene,

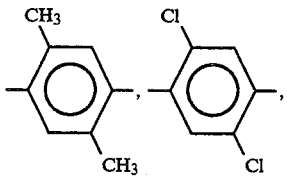

—NHCO—, —CONH—, —O—, —OCO—) and aralkylene groups (for example,

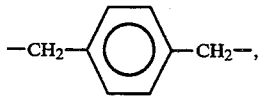

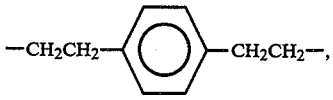

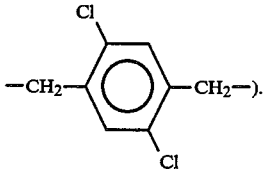

The groups indicated below are preferred linking groups.

$—NHCO—, —CH_2CH_2—,$

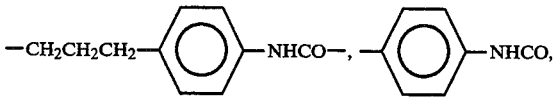

$—CH_2CH_2NHCO—, —CH_2CH_2—O—\underset{\underset{O}{\|}}{C}—,$ $—CONH—CH_2CH_2NHCO—,$ $—CH_2CH_2O—CH_2CH_2—NHCO—,$

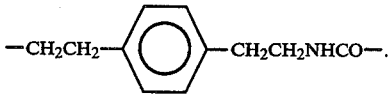

Moreover, the vinyl groups may be unsubstituted or have substituents other than those represented by general (I) or (II), and preferred substituent groups are chlorine atom or lower alkyl groups which have from 1 to 4 carbon atoms (for example, methyl, ethyl), Monomers which contain a moiety represented by general formula (I) or (II) may form copolymers with non-color forming ethylenically unsaturated monomers which do not couple with the oxidation products of a primary aromatic amine developing agent.

Non-color forming ethylenically unsaturated monomers which do not couple with the oxidation products of a primary aromatic amine developing agent include, for example, acrylic acid, α-chloroacrylic acid, α-alkylacrylic acids (for example methacrylic acid) and the esters and amides derived from these acrylic acids (for example, acrylamide, n-butylacrylamide, tertbutylacrylamide, diacetoneacrylamide, methacrylamide, methyl acrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxymethacrylate), methytenedibisacrylamide, vinyl esters (for example, vinyl acetate, vinyl propionate and vinyl laurate), acrylonitrile, methacrylonitrile, aromatic vinyl compounds (for example styrene and derivatives thereof, vinyltoluene, divinylbenzene, vinylacetophenone and sulfostyrene), itaconic acid, citraconic acid, crotonic acid, vinylidene chloride, vinyl alkyl ethers (for example vinyl ethyl ether), maleic acid, maleic anhydride, maleic acid esters, N-vinyl-2-pyrrolidone, N-vinylpyridine and 2- and 4-vinylpyridines. Two or more types of non-color forming ethylenically unsaturated monomers used here can be used in combination, if desired. For example, n-butyl acrylate and methyl acrylate, styrene and methacrylic acid, methacrylic acid and acrylamide, and methyl acrylate and diacetone acrylamide can be used in combination.

The non-color forming ethylenically unsaturated monomer for copolymerization with a solid water insoluble monomeric coupler can be selected from those well known in the field of polymer color couplers in such a way as to affect the physical properties and/or chemical properties, for example, the solubility, compatibility with binding agents such as gelatin for photographic colloid compositions, flexibility and thermal stability, of the copolymers formed.

The polymer couplers which can be used in this present invention may be water soluble or water insoluble, but of these materials polymer coupler latexes are especially desirable.

Preferred couplers represented by general formula (I) are represented by general formulae (I-1), (I-2), (I-3), (I-4), (I-5), (I-6), (I-7), (I-8) (I-9) and (I-10).

(I-1)

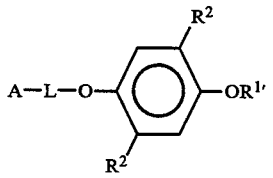

(I-2)

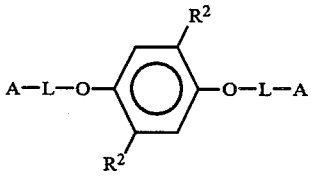

(I-3)

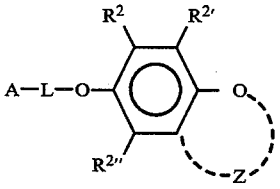

-continued (I-4)

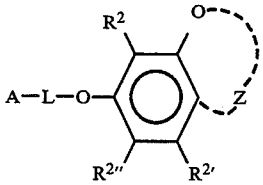

(I-5)

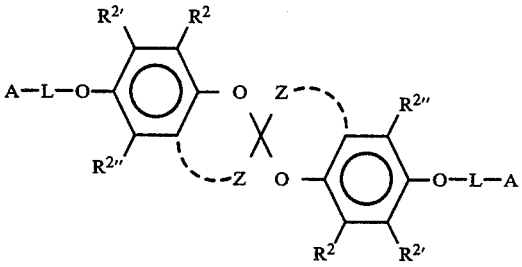

(I-6)

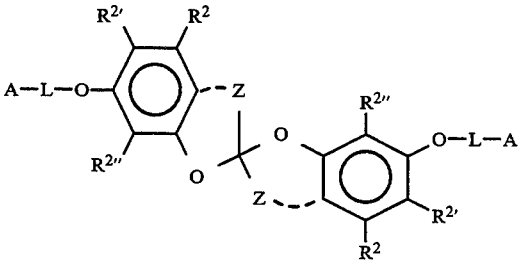

(I-7)

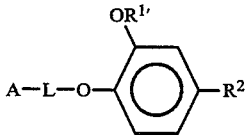

(I-8)

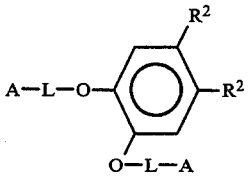

(I-9)

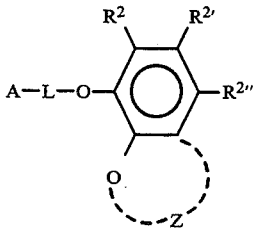

-continued (I-10)

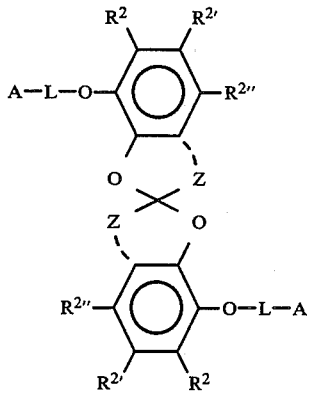

In the above, A, L and $R^2$ represent groups as defined already, and $R^{1'}$ represents a group which has the same significance as $R^1$ but does not contain the AL- group. Furthermore $R^{2'}$ and $R^{2''}$ have the same meaning as $R^2$. Z represents a group which undergoes ring closure together with an oxygen atom or a carbon atom to form a methylenedioxy ring or a five to seven membered ring in general formulae (I-3), (I-4) or (I-9), or to form a five to seven membered ring in general formulae (I-5), (I-6) and (I-10).

Of the couplers represented by general formula (II), those represented by general formulae (II-1), (II-2), (II-3), (II-4), (II-5), (II-6), (II-7), (II-8) and (II-9) are preferred.

(II-1)

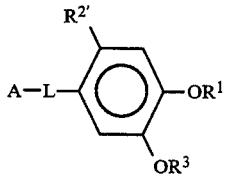

(II-2)

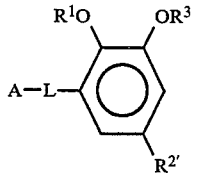

(II-3)

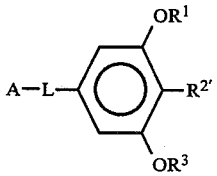

(II-4)

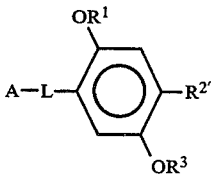

-continued (II-5)

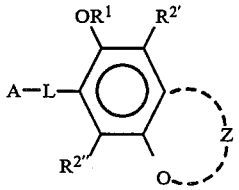

(II-6)

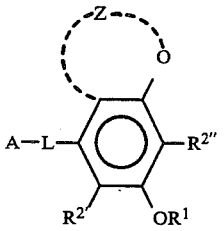

(II-7)

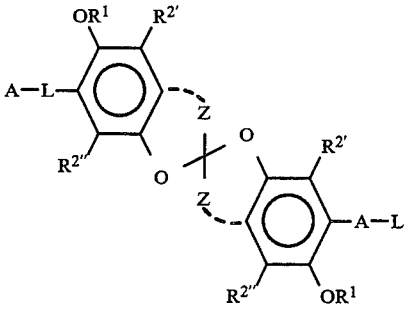

(II-8)

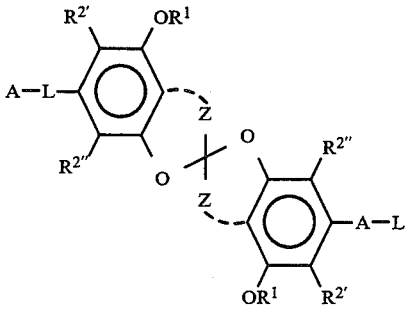

(II-9)

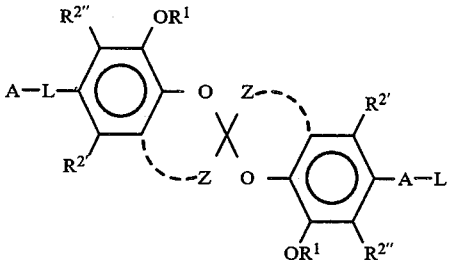

Here, A, L, $R^1$ and $R^3$ represent groups as defined already, and $R^{2'}$ and $R^{2''}$ represent groups as defined for $R^2$ but they do not contain an A-L- group.

Z undergoes ring closure together with an oxygen atom or a carbon atom and represents a group which forms a methylenedioxy ring or a five to seven membered ring in general formulae (II-5) and (II-6), and it represents a group which forms a five to seven membered ring in general formulae (II-7), (II-8) and (II-9).

Of the couplers represented by general formula (I) or general formula (II), those which are represented by general formula (I) are the preferred.

Of the couplers represented by general formulae (I-1) to (I-10), those in which $R^2$, $R^{2'}$ and $R^{2''}$ are hydrogen atoms, unsubstituted alkyl groups or substituted alkyl groups are the most preferred.

Of the couplers represented by general formula (I-1), those which represented by the general formula (I-11) are especially preferred:

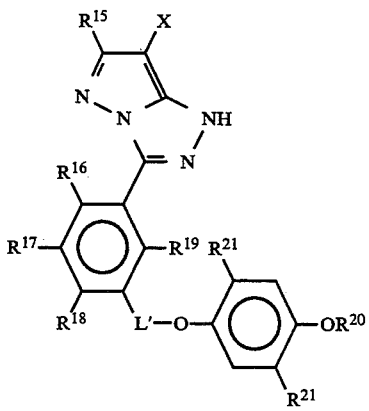

(I-11)

In formula (I-11), $R^{20}$ represents an aryl group or an alkyl group which has 20 carbon atoms or less, and $R^{21}$ represents a hydrogen atom or an alkyl group.

$R^{15}$, $R^{16}$, $R^{17}$, $R^{18}$ and $R^{19}$ have the same significance as $R^{11}$ and $R^{12}$ described already. L' has the same significance as L described already. Furthermore, X has the same significance as X described already.

The most preferred of the couplers represented by general formula (I-11) are those in which $R^{15}$ is an alkyl group and X is a halogen atom or a coupling leaving group which is bonded via an oxygen atom or a nitrogen atom.

In the couplers represented by general formula (I-11), where X is a group which is linked via an oxygen atom or a nitrogen atom, the couplers are especially desirable because there is less yellow staining on storage in the dark than where there is linkage to a halogen atom.

Specific examples of typical magenta couplers and magenta polymer couplers of this present invention are indicated below, but the invention is not to be construed as being limited to these examples.

1)

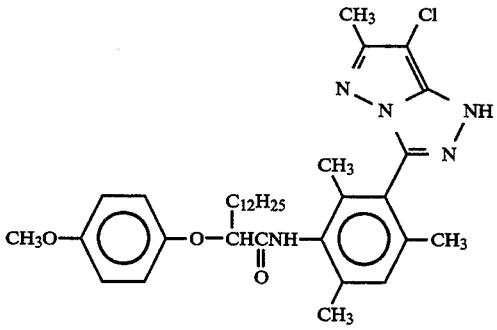

2)

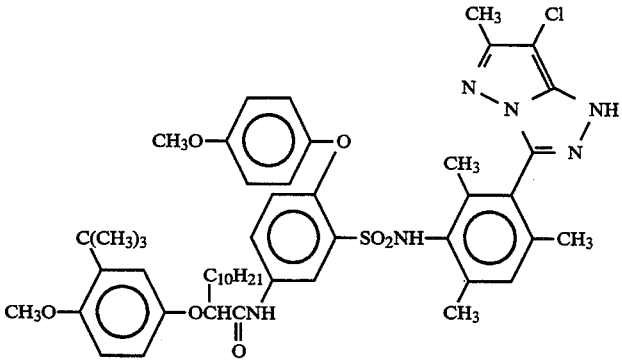

3)

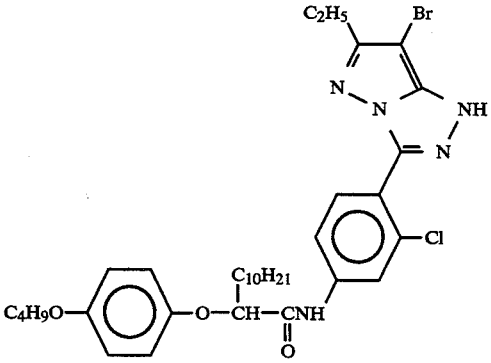

-continued
4)
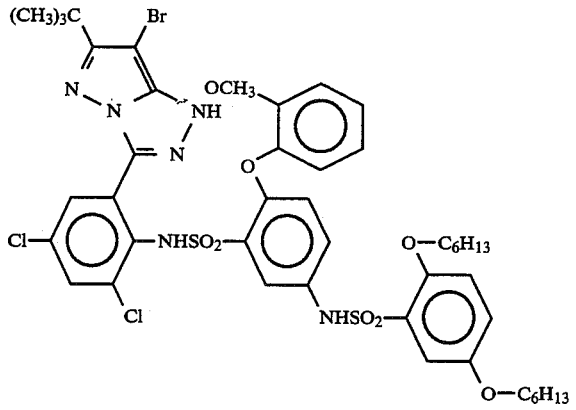
5)
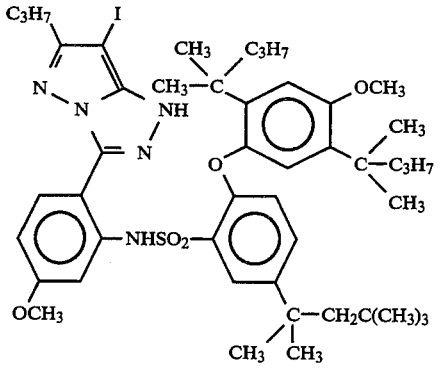
6)
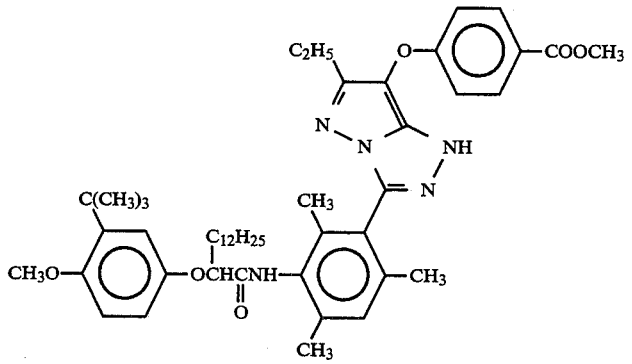
7)
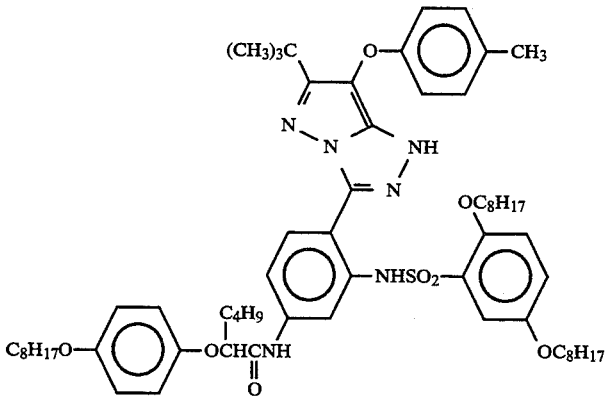

-continued
8)
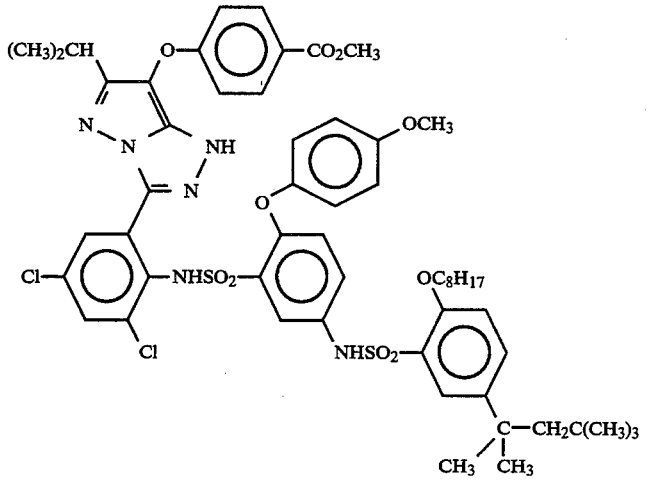
9)
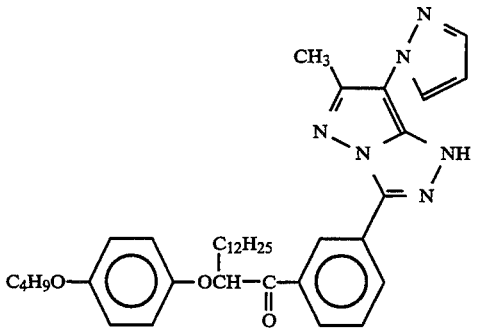
10)
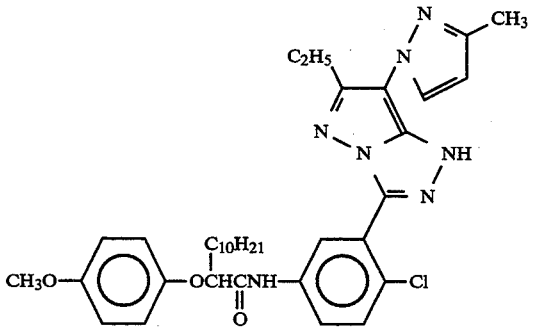
11)
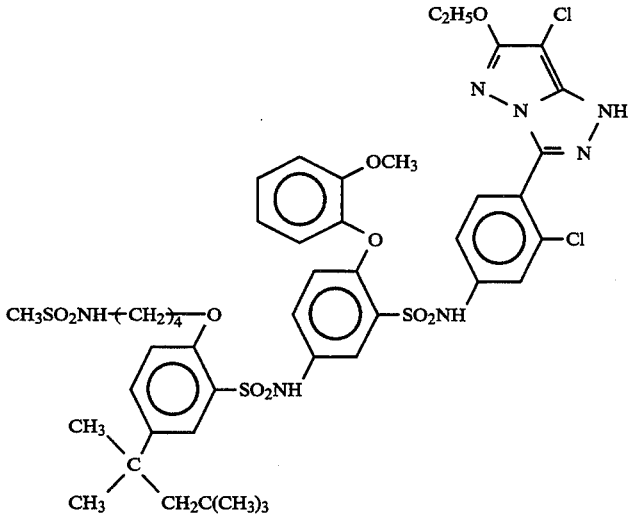

-continued
12)
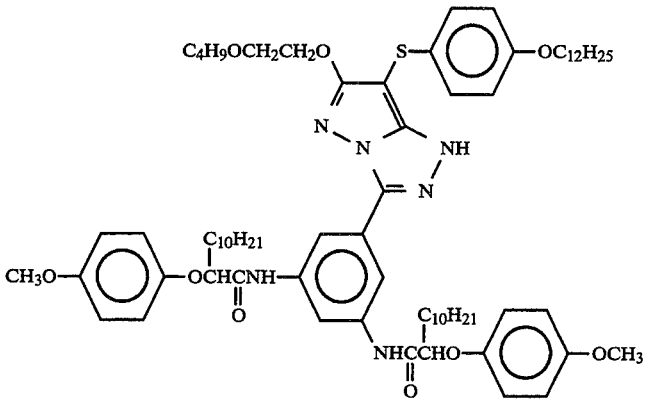
13)
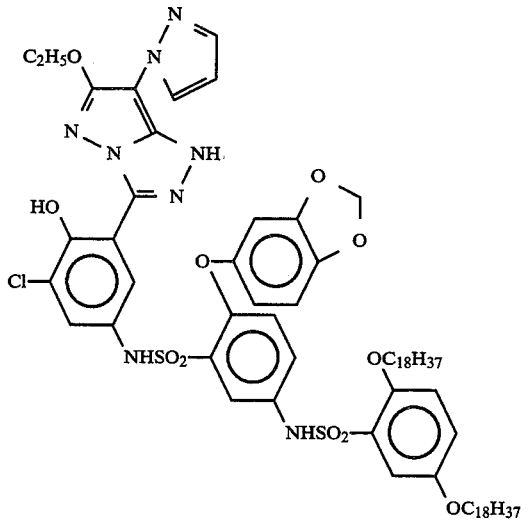
14)
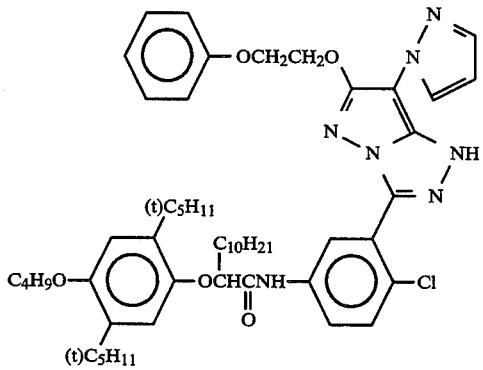

-continued
15)
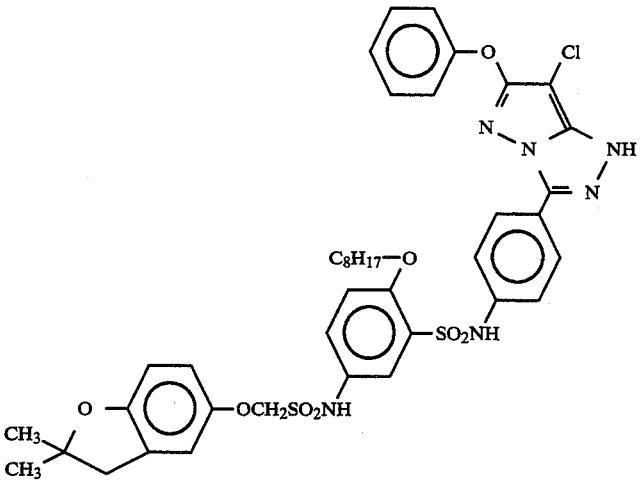
16)
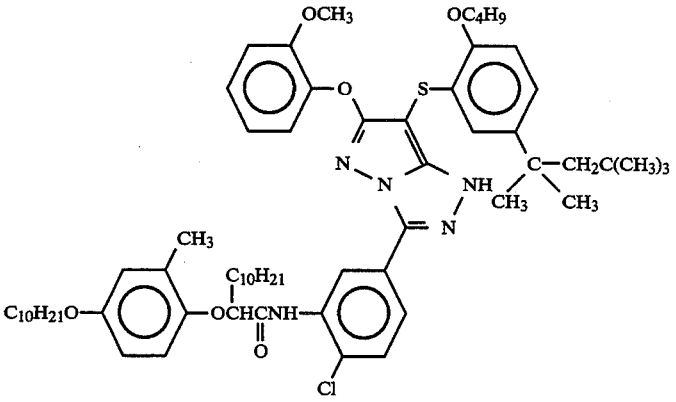
17)
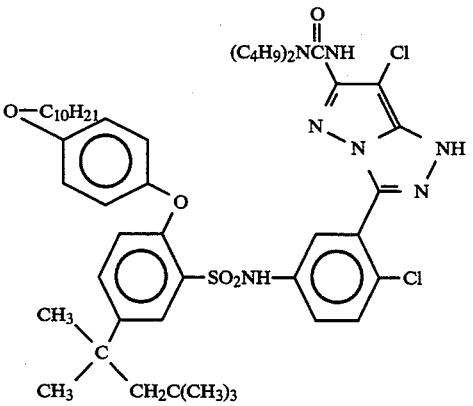
18)
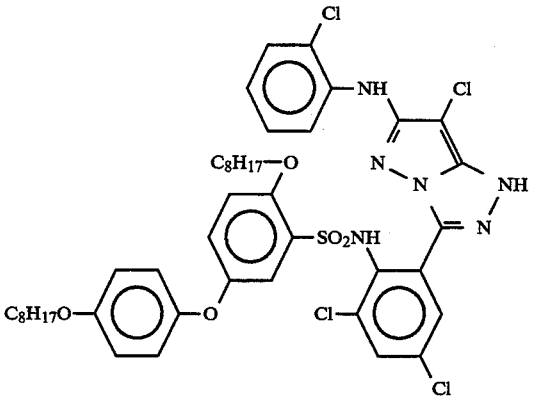

-continued
19)
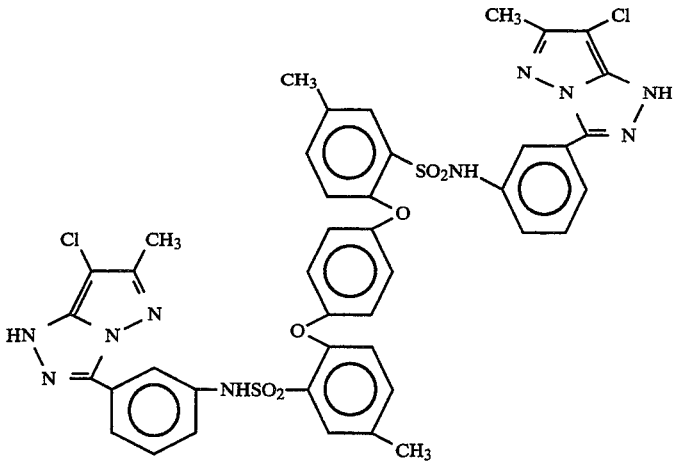
20)
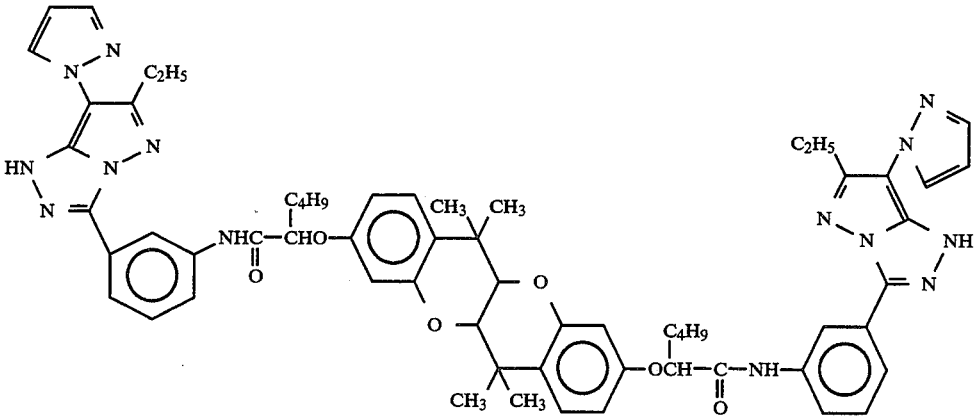
21)
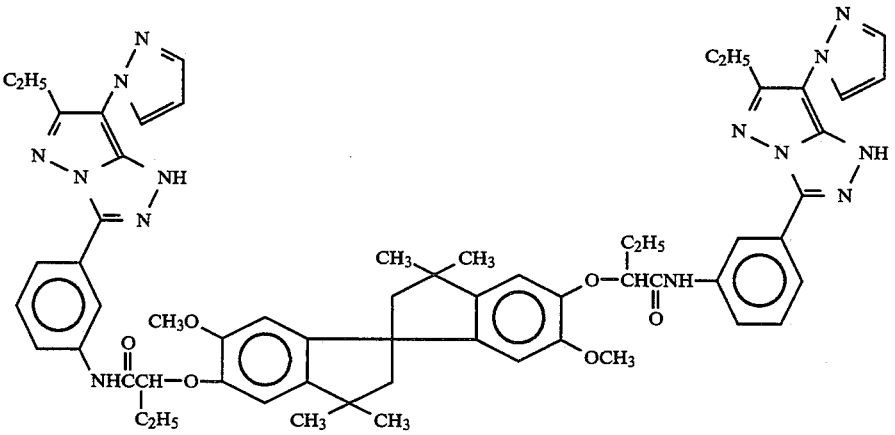
22)
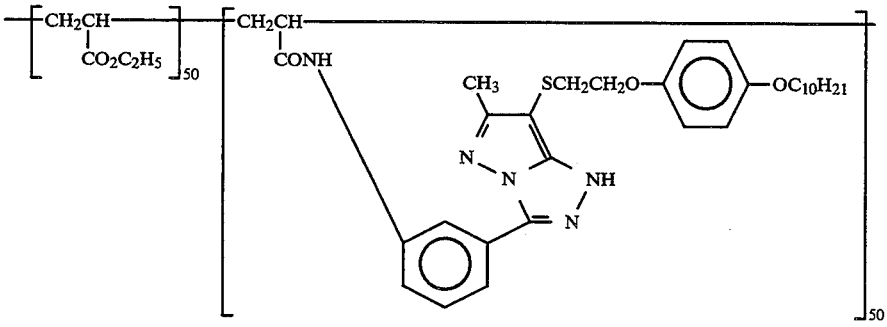

-continued
23)
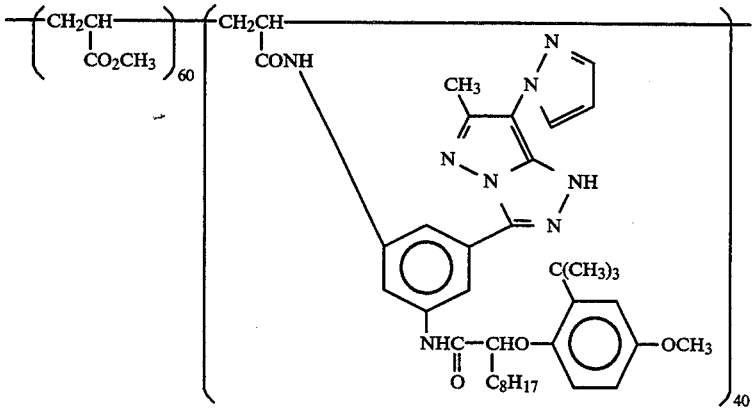
24)
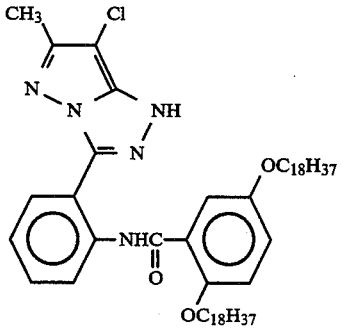
25)
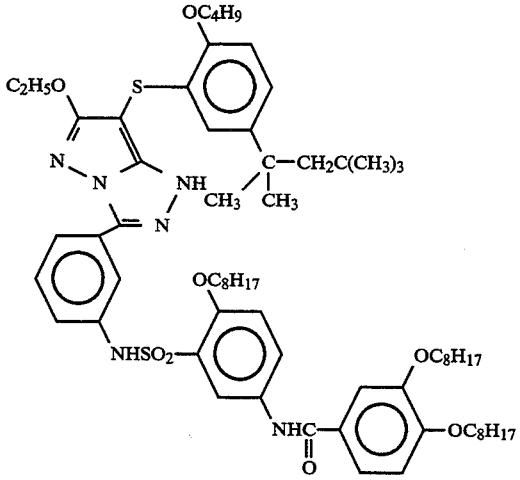
26)
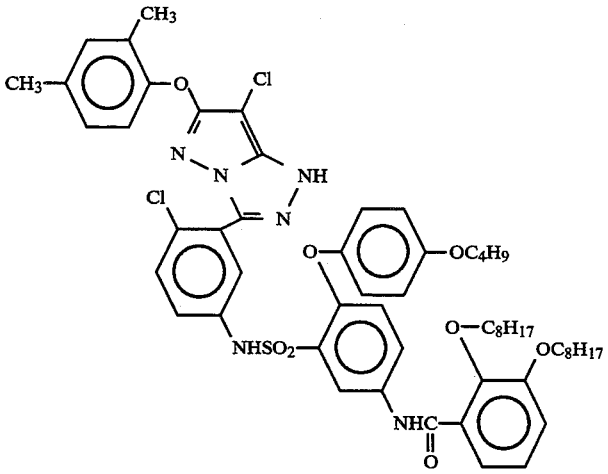

-continued
27)
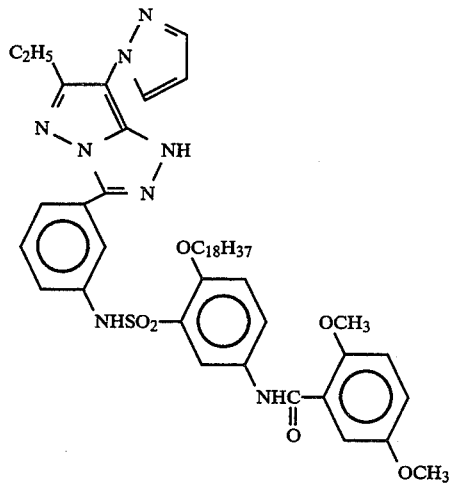
28)
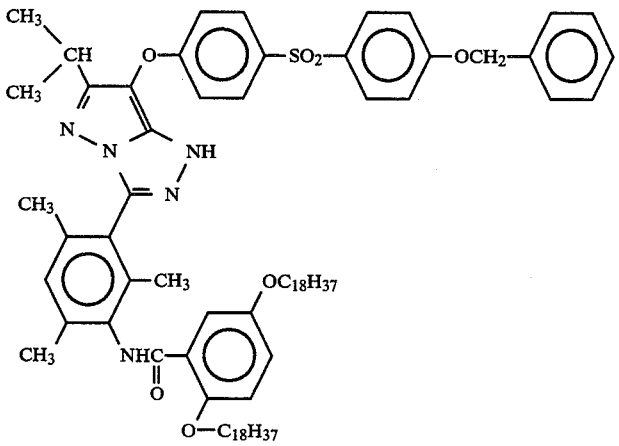
(29)
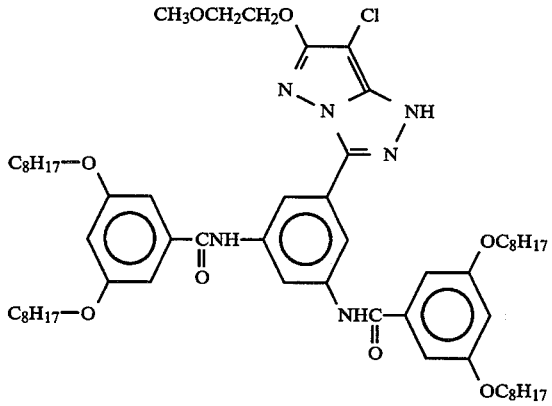

-continued
(30)
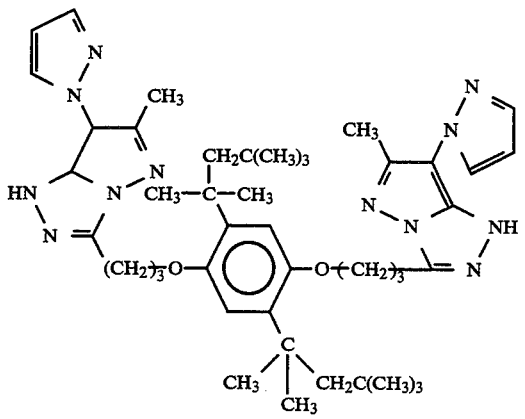
(31)
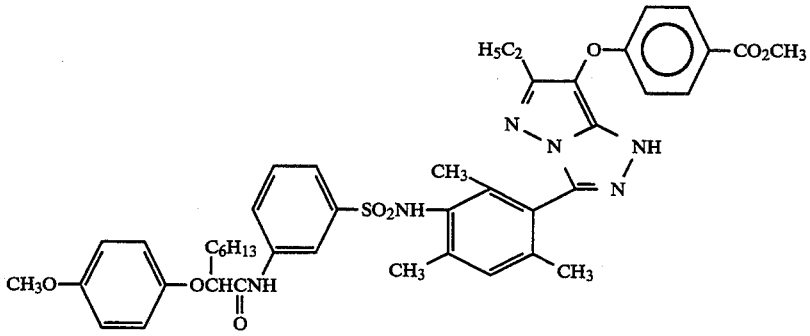
(32)
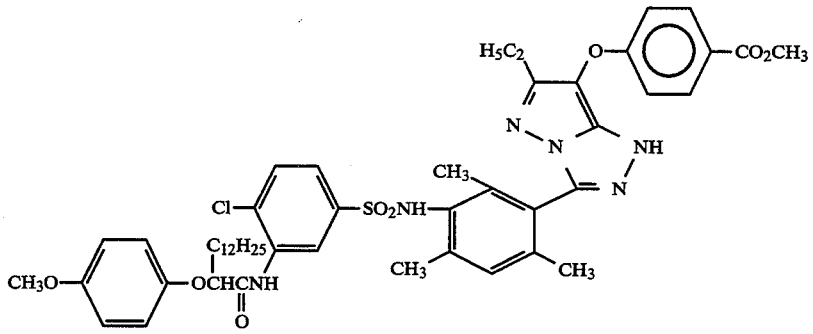
(33)
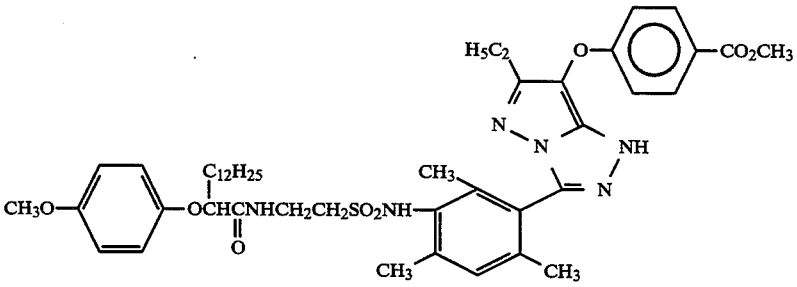

-continued (34)

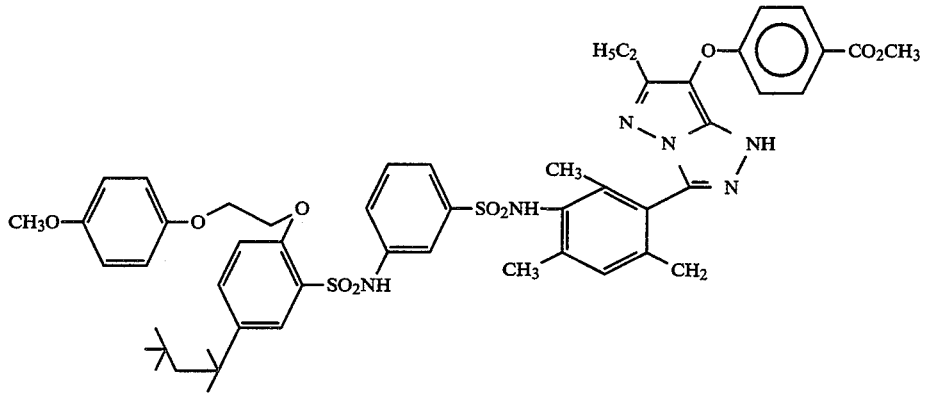

(35)

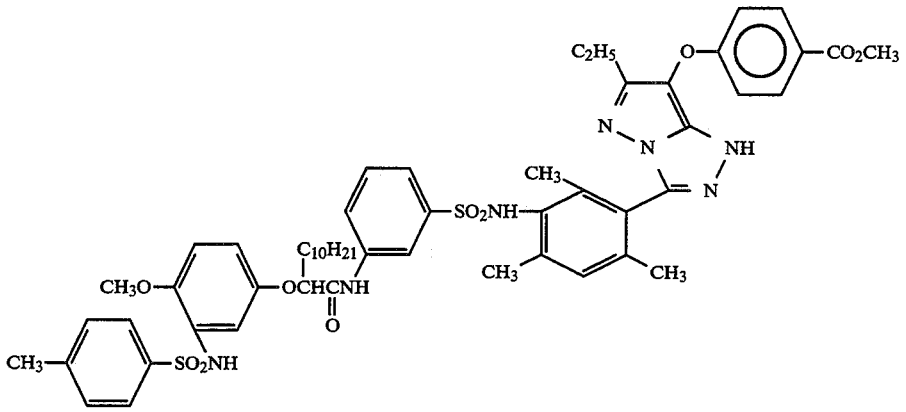

A generic method for the synthesis of couplers of the present invention is described below.

For example, the 1H-pyrazolo[5,1-c]-1,2,4-triazole couplers of the present invention can be prepared using the method disclosed in U.S. Pat. No. 3,725,067 or Japanese Patent Application 2-11765.

The following synthesis example is given to illustrate the synthesis of a coupler of the present invention. Unless otherwise indicated, all parts, percents, ratios and the like are by weight.

SYNTHESIS EXAMPLE (PREPARATION OF COUPLER 1)

Coupler 1) can be prepared by the following reaction schematic.

Coupler 1)

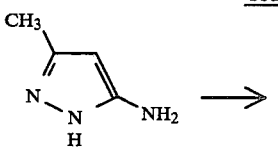

V

-continued

Coupler 1)

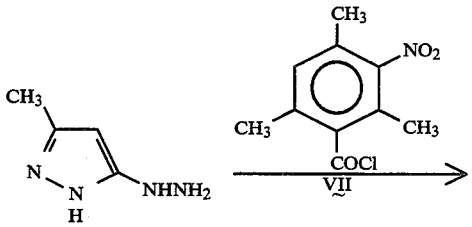

VI

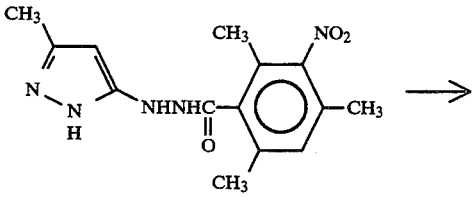

VIII

-continued

Coupler 1)

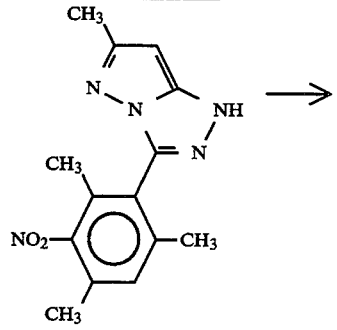

IX

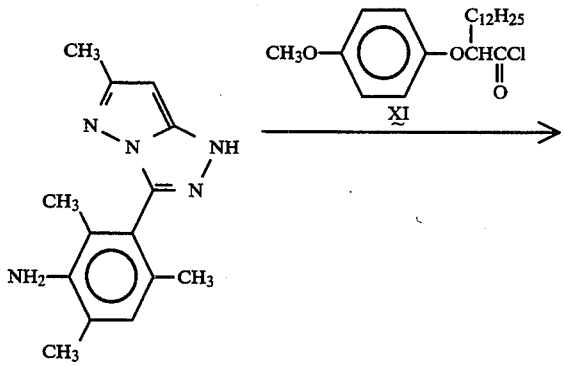

XI

X

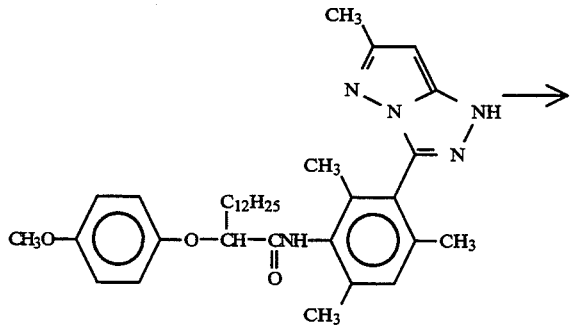

XII

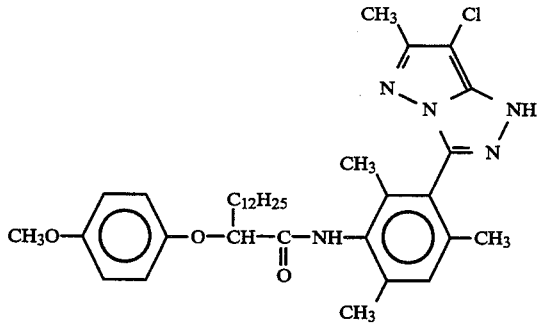

(a) Preparation of Compound VI

5-Amino-3-methyl-1H-pyrazole (V) (388 grams) was added to 3 liters of concentrated hydrochloric acid and stirred in a methanol/ice bath. A solution of 293 grams of sodium nitrite in 520 ml of water was added dropwise while maintaining the temperature at from −5° C. to 0° C. After stirring the mixture for an additional period of 30 minutes while maintaining a temperature of less than 0° C., a solution of 1669 grams of anhydrous stannous chloride in 3 liters of concentrated hydrochloric acid was added dropwise while maintaining a temperature of from 0° C. to 5° C. After stirring for an additional period of 1 hour while maintaining a temperature of not more than 10° C. the crystals which had precipitated were removed by filtration. The crystals were then suspended in 2 liters of benzene and water was removed by heating under reflux using a Dean-Stark water separator, after which the crystals were recovered by filtration and 601 grams of the target Compound IV was obtained. The purity was confirmed using NMR with ethylene glycol as a standard and was found to be 46.3 wt %. The .true recovery was 278 grams and the yield was 62%. NMR (DMSO-$d_6$): $\delta=10.0$ (brS, 2H), 6.8 (brS, 2H), 2.17 (S, 3H).

(b) Preparation of Compound VIII

Acetonitrile (960 ml) was added to 107 grams of Compound VI (purity 46.3 wt %) and stirred in a methanol ice bath. Triethylamine (245 ml) was added dropwise while maintaining the temperature at not more than 0° C. and, after stirring for 10 minutes, 91.1 grams of Compound VII was added while maintaining a temperature of not more than 0° C. After stirring for an additional period of 2 hours while maintaining a temperature of not more than 5° C., the mixture was extracted by addition of 1.5 liters of water and 2 liters of ethyl acetate, and the ethyl acetate layer so obtained was washed three times with 1 liter of saturated salt water. After drying over anhydrous sodium sulfate, the extract was concentrated using a rotary evaporator and the residue so obtained was purified using column chromatography, and 99.5 grams of target Compound VIII was obtained, yield 82%.

(c) Preparation of Compound IX

Acetonitrile (1 liter) was added to 96.8 grams of Compound VIII and the mixture was stirred, and then 123 ml of carbon tetrachloride was added and then 10 grams of triphenylphosphine was added. After stirring for 4 hours at room temperature (about 20°-30° C.), the mixture was heated under reflux and stirred for 2 hours. The mixture was then extracted by the addition of 1 liter of water and 2 liters of ethyl acetate, 53 ml of triethylamine was added to the ethyl acetate layer so obtained and the mixture was stirred for 5 minutes. Then, after washing three times with 1 liter of saturated salt water, the ethyl acetate layer was dried using anhydrous sodium sulfate and concentrated using a rotary evaporator. The residue obtained was purified using column chromatography and 67.3 grams of target Compound IX was obtained, yield 74%.

(d) Preparation of Compound X

Acetic acid (5.6 ml) and 80 ml of water were added to 55.8 grams of reducing iron and 5.6 grams of ammonium chloride, and the mixture was heated under reflux, with stirring, for 30 minutes. Then, 400 ml of isopropanol was added and the mixture was again heated under reflux and stirred while 57.0 grams of Compound IX was added. Then, the refluxing and stirring was continued for 1 hour, the insoluble material was removed by filtration and the solution obtained was concentrated using a rotary evaporator whereupon target Compound X was obtained as a crude product.

(e) Preparation of Compound XII

Crude Compound X as obtained above was dissolved in 300 ml of N,N-dimethylacetamide and the solution was stirred. Compound XI (66.4 grams) was added dropwise and then 14.5 ml of pyridine was added dropwise. After stirring for 3 hours at room temperature, the mixture was extracted with the addition of 1 liter of water and 1.5 liters of ethyl acetate and the ethyl acetate layer obtained was washed three times with 1 liter of saturated salt solution. After drying with anhydrous sodium sulfate, the extract was concentrated using a rotary evaporator and the residue obtained was purified using column chromatography, and 71.7 grams of target Compound XII was obtained, a 61% yield from Compound IX.

(f) Preparation of Coupler 1)

Compound XII (47.0 grams) was dissolved in 500 ml of ethyl acetate and 10.7 grams of N-chlorosuccinimide was added with stirring at room temperature. After stirring for 30 minutes at room temperature, the mixture was extracted by addition of 300 ml of water and the ethyl acetate layer obtained was washed twice with 300 ml of saturated salt water. After drying using anhydrous sodium sulfate, the mixture was concentrated using a rotary evaporator and 42.3 grams of the Coupler 1) was obtained, yield 85%.

Couplers which have phenyl ether groups at the end of the coupler molecule are disclosed in JP-A-55-7702. (The term "JP-A" as used herein signifies an "unexamined published Japanese patent application".) Furthermore, couplers which have cyclic ether groups are disclosed in JP-A-53-82411. Moreover, couplers which have phenyl ether groups on a magenta coupler which has a pyrazoloazole parent nucleus are disclosed in JP-A-63-24256. The couplers of this present invention are included within the generic scope of the general formula disclosed in JP-A-63-24256 but no suggestion for couplers of the general formula (I) is disclosed therein. The couplers of this present invention exhibit specifically superior light fastness when compared with the specific couplers disclosed in these patents.

The couplers of the present invention are preferably added to a silver halide photosensitive emulsion layer, but they may be added to an essentially non-photosensitive intermediate layer which is positioned adjacent to an emulsion layer. Furthermore, no particular limitation is imposed upon the layer to which the addition is made in those cases where an emulsion layer is separated into a high speed layer, an intermediate speed layer and a low speed layer. The couplers of the present invention may be used in a coupler-in-developer system.

The amount of coupler of this present invention which is employed is generally within the range from 0.1 mmol to 2 mmol per square meter of photosensitive material, though no particular limitation exists as to the amount which is employed.

A photosensitive material of this present invention comprises a support having thereon at least one blue sensitive silver halide emulsion layer, at least one green sensitive silver halide emulsion layer and at least one red sensitive silver halide emulsion layer, but no particular limitation exists as to the number or order of the silver halide emulsion layers and non-photosensitive layers. Typically, a silver halide photographic material comprises a support having thereon at least one photosensitive layer comprising a plurality of silver halide emulsion layers which have essentially the same color sensitivity but different photographic speeds, this photosensitive layer being a unit photosensitive layer which is color sensitive to blue light, green light or red light, and in a multi-layer silver halide color photographic material the arrangement of the unit photosensitive layers generally involves their positioning, in the order from the support side, of a red sensitive layer, a green sensitive layer, and a blue sensitive layer. However, this order may be changed, as required, and the layers may be arranged in such a way that a layer which has a different color sensitivity is sandwiched between layers which have the same color sensitivity.

Various non-photosensitive layers, such as intermediate layers, for example, may be positioned between the above mentioned silver halide photosensitive layers, and as uppermost and lowermost layers.

These intermediate layers may contain couplers and DIR compounds for example as disclosed in the specifications of JP-A-61-43748, JP-A-59-113438, JP-A-59-113440, JP-A-61-20037 and JP-A-61-20038, and they may also contain the generally used anti-color mixing compounds.

The plurality of silver halide emulsion layers forming each unit photosensitive layer is preferably a double layer structure comprising a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be positioned between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and JP-A-62-206543.

More specifically, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, arrangements comprising three layers which have different speeds with the photosensitivity decreasing towards the support with the silver halide emulsion layer of the highest photosensitivity on the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495, can be used. Where structures of this type which have three layers with different photosensitivities are used, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order high speed emulsion layer/low speed emulsion layer/intermediate speed emulsion layer, or low speed emulsion layer/intermediate speed emulsion layer/high speed emulsion layer for example.

Furthermore, the arrangement may be varied in the ways indicated above where there are four or more layers.

Various layer structures and arrangements can be selected as described above depending on the purpose of the photosensitive material.

Preferred silver halides for the photographic emulsion layers of the photographic material of the present invention are silver iodobromides, silver iodochlorides or silver iodochlorobromides which contain not more than about 30 mol % of silver iodide. Most preferably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine at less that about 0.2 microns, or large with a projected area diameter of up to about 10 microns, and the emulsions may be poly-disperse emulsions or monodisperse emulsions.

The silver halide photographic emulsions which can be used in this present invention can be prepared, for example, using the methods disclosed in *Research Disclosure* (RD) No. 17643 (December, 1978), pages 22–23, "I. Emulsion Preparation and Types", *Research Disclosure* No. 18716 (November 1979), page 648, and *Research Disclosure,* No. 307105 (November 1989), pages 863–865, in P. Glafkides, *Chimie et Physique Photographique,* published by Paul Montel, 1967, in G. F. Duffin, *Photographic Emulsion Chemistry,* published by Focal Press, 1966, and in V. L. Zelikmann et al., *Making and Coating Photographic Emulsions,* published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in the present invention. Tabular grains can be prepared easily using the methods described, for example, in Gutoff, *Photographic Science and Engineering,* Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior portions of the grains may have different halogen .compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above described emulsions may be of the surface latent image type where the latent image is formed principally on the surface, the internal latent image type where the latent image is formed within the grains, or of a type where the latent image is formed both at the surface and within the grains, but a negative type emulsion is preferred. Of the internal latent image types, the emulsion may be a core/shell internal latent image type emulsion as disclosed in JP-A-63-264740. A method for the preparation of such a core/shell internal latent image type emulsion is disclosed in JP-A-59-133542. The thickness of the shell of the emulsion differs according to the development processing, for example, but is preferably from 3 to 40 nm, and most desirably from 5 to 20 nm.

The silver halide emulsions generally are subjected to physical ripening, chemical ripening and spectral sensitization. Additives which are used in such processes are disclosed in *Research Disclosure,* Nos. 17643, 18716 and 307105, and the relevant disclosures are summarized in the table given below.

Two or more different types of emulsions which differ in terms of at least one of the characteristics of grain size, grain size distribution or halogen composition of the photosensitive silver halide emulsion, the form of the grains or photographic speeds can be used in the form of a mixture in the same layer in the photosensitive material of the present invention.

The use of silver halide grains where the grain surface has been fogged as disclosed in U.S. Pat. No. 4,082,553, silver halide grains of which the grain interior has been fogged as disclosed in U.S. Pat. No. 4,626,498 and JP-A-59-214852 or colloidal silver is desirable in the photosensitive silver halide emulsion layers and/or essentially non-photosensitive hydrophilic colloid layers. Silver halide grains of which the grain interior or surface has been fogged are silver halide grains which can be developed uniformly (not as an image) irrespective of whether they are in an unexposed area or an exposed area of the photosensitive material. Methods for the preparation of silver halide grains of which the interior or surface has been fogged are disclosed in U.S. Pat. No. 4,626,498 and JP-A-59-214852.

The silver halide which forms the internal nuclei of core/shell type silver halide grains where the grain interior has been fogged may have the same halogen composition or a different halogen composition. The silver halide where the grain interior or surface has been fogged may be silver chloride, a silver chlorobromide, a silver iodobromide or a silver chloroiodobromide. No particular limitation is imposed upon the grain size of these fogged silver halide grains, but an average grain size of from 0.01 to 0.75 μm, and especially of from 0.05 to 0.6 μm, is preferred. form of the grains and they may be regular grains, and they may be poly-disperse emulsions, but mono-disperse emulsions (in which at least 95% in terms of the weight or number of silver halide grains have a grain size within ±40% of the average grain size) are preferred.

The use of non-photosensitive fine grained silver halides is desirable in this present invention. Non-photosensitive fine grained silver halides are fine grained silver halides which are not photosensitive at the time of the imagewise exposure to obtain the dye image and which undergo essentially no development during development processing, and they may be pre-fogged.

The fine grained silver halide has a silver bromide content from 0 to 100 mol % and may contain silver chloride and/or silver iodide as necessary. Those which have a silver iodide content of from 0.5 to 10 mol % are preferred.

The fine grained silver halide has an average grain size (the average value of the diameters of the circles corresponding to the projected areas) preferably of from 0.01 to 0.5 μm, and most desirably of from 0.02 to 0.2 μm.

The fine grained silver halide can be prepared using the same methods used in general for the preparation of photosensitive silver halides. In this case, the surface of the silver halide grains does not need to be optically sensitized and neither is there any need for spectral sensitization. However, the pre-addition of known stabilizers such as triazole, azaindene, benzothiazolium or mercapto based compounds or zinc compounds, for example, before addition to the coating liquid is desirable. Colloidal silver can also be included advantageously in the layers which contain these fine grained silver halide grains.

The coated weight of silver- in the photosensitive material of the present invention is preferably not more than 6.0 g/m$^2$, and most desirably not more than 4.5 g/m$^2$.

Known photographically useful additives which can be used in this present invention are also disclosed in the *Research Disclosures* references shown in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Super-Sensitizers | Pages 23–24 | Page 648 right hand column - page 649 right hand column | Pages 866–868 |
| 4. Bleaching Agents | Page 24 | Page 647, right hand column | Page 868 |
| 5. Anti-Foggants, Stabilizers | Pages 24–25 | Page 649, right hand column | Pages 868–870 |
| 6. Light Absorbers, Filter Dyes and Ultraviolet Absorbers | Pages 25–26 | Page 649, right hand column - page 650, left hand column | Page 873 |
| 7. Anti-Staining Agents | Page 25, right hand column | Page 650, left hand column - right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating Promoters Surfactants | Pages 26–27 | Page 650, right hand column | Pages 875–876 |
| 13. Anti-Static Agents | Page 27 | Page 650, right hand column | Pages 876–877 |
| 14. Matting Agents | | | Pages 878–879 |

Furthermore, addition of the compounds which react with and fix formaldehyde as disclosed in U.S. Pat. Nos. 4,411,987 and 4,435,503 to the photosensitive material is desirable to prevent a deterioration of photographic performance due to formaldehyde gas.

The inclusion of the mercapto compounds disclosed in U.S. Pat. Nos. 4,740,454 and 4,788,132, JP-A62-18539 and JP-A-1-283551 is desirable in the photosensitive material of the present invention.

The inclusion of compounds which release fogging agents, development accelerators, silver halide solvents or precursors of these materials irrespective of the amount of developed silver produced by development processing disclosed in JP-A-l-106052 is preferred in the photosensitive material of the present invention.

The inclusion of dyes dispersed using the methods disclosed in International Patent (laid open) WO88/04794 and JP-A-1-502912, or the dyes disclosed in EP 317,308A, U.S. Pat. No. 4,420,555 and JP-A-1-259358 is desirable in the photosensitive material of the present invention.

Various color couplers can be used in the photosensitive material of the present invention, and actual examples are disclosed in the patents cited in the above-described *Research Disclosure,* No. 17643, sections VII-C–G, and *Research* Disclosure, No. 307105, sections VII-C–G.

Those yellow couplers disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers. (The term "JP-B" as used herein signifies an "examined Japanese patent publication".)

Those magenta couplers disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO88/04795, in addition to those of the present invention, are especially desirable as magenta couplers.

Phenol and naphthol based couplers are suitable as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent laid open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. Moreover, the pyrazoloazole based couplers disclosed in JP-A-64-553, JP-A-64-554, JP-A-64-555 and JP-A-64-556, and the imidazole based couplers disclosed in U.S. Pat. No. 4,818,672 can also be used.

Furthermore, the cyan couplers disclosed in JP-B-59-33903 have excellent absorption characteristics and they are especially desirable for increasing fastness.

Typical examples of polymerized dye forming couplers are disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

Colored couplers for correcting the undesired absorptions of colored dyes disclosed, for example, in section VII-G of *Research Disclosure,* No. 17643, section VII-G of *Research Disclosure,* No. 307105, U.S. Pat. No. 4,163,670, JP-B-57-39413, U.S. Pat. Nos. 4,004,929 and 4,138,258, and British Patent 1,146,368 are desirable. Furthermore, the use of couplers which correct the undesired absorption of colored dyes using fluorescent dyes which are released on coupling as disclosed in U.S. Pat. No. 4,774,181, and couplers which have, as leaving groups, dye precursor groups which form dyes on reaction with the developing agent as disclosed in U.S. Pat. No. 4,777,120 is also desirable.

The use of compounds which release photographically useful residual groups on coupling is also desirable in the present invention. The DIR couplers which release development inhibitors disclosed in the patents cited in section VII-F of *Research Disclosure,* No. 17643 and section VII-F of *Research Disclosure,* No. 307105, JP-A-57-151944, JP-A-57-154234, JP-A-60-184248, JP-A-63-37346, JP-A-63-37350 and U.S. Pat. Nos. 4,248,962 and 4,782,012 are desirable.

The bleaching accelerator releasing couplers disclosed in *Research Disclosure,* No. 11449, *Research Disclosure,* No. 24241 and JP-A-61-201247 are effective for shortening the time of the processing operation which has a bleaching function, and they are particularly effective where they are used in photosensitive materials with the above-described tabular silver halide grains.

The couplers disclosed in British Patents 2,097,140 and 2,131,188, JP-A-59-157638 and JP-A-59-170840 are preferred as couplers which release nucleating agents or development accelerators in correspondence with development image. Furthermore, compounds which release fogging agents, development accelerators, silver halide solvents etc. using a redox reaction with the oxidized form of a developing agent disclosed in JP-A-60-107029, JP-A-60-252340, JP-A-1-44940 and JP-A-1-45687 are also desirable.

Other compounds which can be used in photosensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after elimination disclosed in European Patents 173,302A and 313,308A, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in this present invention can be introduced into a photosensitive material using a variety of known dispersion methods.

Examples of high boiling point solvents which can be used in the oil in water dispersion method are disclosed, for example, in U.S. Pat. No. 2,322,027.

Specific examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl-)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate ), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, iso-stearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and diisopropylnaphthalene). Furthermore, organic solvents which have a boiling point above about 30° C., and preferably of at least 50° C., but below about 160° C., at normal pressure can be used as auxiliary solvents, and typical examples of such solvents include ethyl acetate, butyl acetate, ethyl propionate, methyl ethyl ketone, cyclohexanone, 2-ethoxyethyl acetate and dimethylformamide.

The processes and effects of the latex dispersion method and actual examples of latexes for loading purposes are disclosed, for example, in U.S. Pat. Nos. 4,199,363, and in West German Patent Applications (OLS) 2,541,274 and 2,541,230.

The addition to the color photosensitive materials of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole, for example, as disclosed in JP-A-63-257747, JP-A-62-272248 and JP-A-1-80941, is desirable.

This present invention can be employed in a variety of color photosensitive materials. Typical examples include color negative films for general and cinematographic purposes, color reversal films for slides and television purposes, color papers, color positive films and color reversal papers.

Suitable supports which can be used in this present invention are disclosed, for example, on page 28 of *Research Disclosure,* No. 17643, from the right hand column of page 647 to the left hand column of page 648 of *Research Disclosure,* No. 18716, and on page 879 of *Research Disclosure,* No. 307105.

The photosensitive materials of the present invention are such that the total film thickness of all of the hydrophilic colloid layers on the side where the emulsion layers are located is preferably 28 μm or less, more desirably 23 μm or less, even more desirably 18 μm or less, and most desirably 16 μm or less. Furthermore, the film swelling rate $T_{\frac{1}{2}}$ is preferably 30 seconds or less and most desirably 20 seconds or less. Here, the film thickness signifies the film thickness measured under conditions of 25° C., 55% relative humidity (2 days) and the film swelling rate $T_{\frac{1}{2}}$ is that measured using the methods well known to those in the photographic art. For example, measurements can be made using a swellometer of the type described in A. Green, *Photogr. Sci. Eng.,* Volume 19, Number 2, pages 124–129, and $T_{\frac{1}{2}}$ is defined as the time required to reach half the saturated film thickness, taking 90% of the maximum swelled film thickness reached on processing the material for 3 minutes 15 seconds in a color developer at 30° C. as the saturated film thickness.

The film swelling rate $T_{\frac{1}{2}}$ can be adjusted by adding film hardening agents for the gelatin which is used as a binder, or by changing the ageing conditions after coating. Furthermore, a swelling factor of from 150% to 400% is preferred. The swelling factor can be calculated from the maximum swollen film thickness obtained under the conditions described above using the expression (maximum swelled film thickness minus film thickness)/film thickness.

The establishment of a hydrophilic colloid layer (known as a backing layer) of a total dry film thickness from 2 μm to 20 μm on the opposite side from the emulsion layers is desirable in the photosensitive material of the present invention. The inclusion of light absorbing agents, filter dyes, ultraviolet absorbers, anti-static agents, film hardening agents, binders, plasticizers, lubricants, coating promoters and surfactants, for example, as described before, in this backing layer is desirable. The swelling factor of the backing layer is preferably from 150% to 500%.

Color photographic materials in accordance with the present invention can be developed and processed using conventional methods, e.g., as disclosed on pages 28–29 of *Research Disclosure,* No. 17643, from the left hand column to the right hand column and on page 615 of *Research Disclosure,* No. 18716, and on pages 880 to 881 of *Research Disclosure,* No. 307105.

The color developers used for the development processing of the photosensitive materials of this present invention are preferably aqueous alkaline solutions which contain a primary aromatic amine based color developing agent as the principal component. Aminophenol based compounds are also useful as color developing agents, but the use of p-phenylenediamine based compounds is preferred. Typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. Of these compounds, 3-methyl-4-amino-N-ethyl-N-β-hydroxyethylaniline sulfate is especially desirable. Two or more of these compounds can be used in combination, depending on the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. The developer may also contain, as desired, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids. Typical examples of these compounds include ethylenediamine tetraacetic acid, nitrilotriacetic acid, diethylenetriamine pentaacetic acid, cyclohexanediamine tetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development is carried out after a normal black and white development where reversal processing is used. Known black and white developing agents including dihydroxybenzenes such as hydroquinone, 3-pyrazolidones such as 1-phenyl-3-pyrazolidone, and aminophenols such as N-methyl-p-aminophenol, for example, which agents can be used individually or in combinations, in the black and white developer.

The pH of these color developers and black and white developers is generally from 9 to 12. Furthermore, the replenishment rate for these developers depends on the color photographic material which is being processed but, in general, it is 3 liters or less per square meter of photosensitive material, and it can be set to 500 ml or less by reducing the bromide ion concentration in the replenisher. Where the replenishment rate is low it is desirable to prevent evaporation and aerial oxidation of the liquid by minimizing the area of contact with air in the processing tank.

The contact area between the air and the photographic processing bath in a processing tank can be represented by the open factor which is defined below.

$$\text{Open Factor} = \frac{\text{Processing Bath Air Contact Area (cm}^2\text{)}}{\text{Processing Bath Volume (cm}^3\text{)}}$$

The above described open factor is preferably 0.1 or less, and most desirably from 0,001 to 0.05. In addition to the use of a shielding material such as a floating lid, for example, on the surface of the photographic processing bath in the processing tank, the method using a movable lid as disclosed in JP-A-1-82033 and the method involving slit development processing as disclosed in JP-A-63-216050 can be used as means of reducing the open factor. Reduction of the open factor is preferably achieved not only during the processes of color development and black and white development but also during all subsequent processes, such as bleaching, bleach-fixing, fixing, water washing and stabilizing processes for example. Furthermore, the replenishment rate can be reduced using means to suppress the accumulation of bromide ion in the development bath.

The color development processing time is generally set between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as the fixing process (e.g., a bleach-fix process) or it may be carried out separately. Moreover, a bleach-fix process can be carried out after a bleaching process in order to speed up processing. Moreover, processing can be carried out in two connected bleach-fix baths, a fixing process can be carried out before a bleach-fixing process or a bleaching process can be carried out after a bleach-fix process, as desired. Compounds of multivalent metals, such as iron(III) for example, peracids, quinones and nitro compounds can be used as bleaching agents. Typical bleaching agents include organic complex salts of iron(III), for example complex salts with aminopolycarboxylic acids such as ethylenediamine tetraacetic acid, diethylenetriamine pentaacetic acid, cyclohexane-diamine tetraacetic acid, methylimino diacetic acid, 1,3-diaminopropane tetraacetic acid and glycol ether diamine tetraacetic acid, or citric acid, tartaric acid or malic acid. From among these materials, the use of aminopolycarboxylic acid iron(III) complex salts, and principally ethylenediamine tetraacetic acid iron(III) complex salts and 1,3-diaminopropane tetraacetic acid iron(III) salts, is preferred from the standpoint of both rapid processing and prevention of environmental pollution. Moreover, aminopolycarboxylic acid iron(III) complex salts are especially useful in both bleach baths and bleach-fix baths. The pH of the bleach baths and bleach-fix baths in which these aminopolycarboxylic acid iron(III) salts are used is generally from 4.0 to 8, but lower pH's can be used in order to speed up processing.

Bleaching accelerators can be used, as necessary, in the bleach baths, bleach-fix baths or bleach or bleach-fix prebaths. Specific examples of useful bleach accelerators are disclosed in the following specifications: Thus, examples include compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and the bromide ion. Those compounds which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the photosensitive material. These bleaching accelerators are especially effective when bleach-fixing camera color photosensitive materials.

The inclusion of organic acids as well as the compounds indicated above in the bleach baths and bleach-fix baths is desirable to prevent the bleach staining from occurring. Compounds which have an acid dissociation constant (pKa) of from 2 to 5 are especially desirable as organic acids, and in practice, acetic acid, propionic acid and hydroxyacetic acid, for example, are preferred.

Thiosulfate, thiocyanate, thioether based compounds, thioureas and large amounts of iodide can be used, for example, as the fixing agent which is used in a fixing bath or bleach-fixing bath, but thiosulfate is generally used, and ammonium thiosulfate in particular can be used in the widest range of applications. Furthermore, the combined use of thiosulfates and thiocyanates, thioether compounds, thioureas, etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable to stabilize these baths.

The addition of compounds with a pKa from 6.0 to 9.0, and preferably imidazoles such as imidazole, 1-methylimidazole, 1-ethylimidazole and 2-methylimidazole in amounts of from 0.1 to 10 mol/liter of the fixing bath or bleach-fixing bath is desirable in the present invention.

A short total de-silvering processing time within the range where lack of de-silvering does not occur is preferred. The de-silvering time is preferably from 1 to 3 minutes, and most desirably from 1 to 2 minutes. Furthermore, the processing temperature is from 25° C. to 50° C., and preferably from 35° C. to 45° C. The de-silvering rate is improved and the occurrence of staining after processing is effectively prevented within the preferred temperature range.

Agitation as strongly as possible during the de-silvering process is desirable. Specific examples of methods of achieving strong agitation include methods in which a jet of processing liquid is impinged on the emulsion surface of the photosensitive material as disclosed in JP-A-62-183460, the method in which the agitation effect is increased using a rotary device as disclosed in JP-A-62-183461, the method in which the photosensitive material is moved with a wiper blade established in the bath, in contact with the emulsion surface and the agitation effect is increased by the generation of a turbulence at the emulsion surface, and the method in which the circulating flow rate of the processing bath as a whole is increased. These means of increasing agitation are effective in bleach -baths, bleach-fix baths and fixing baths. It is thought that increased agitation increases the rate of supply of bleaching agent and fixing agent to the emulsion film and consequently increases the de-silvering rate. Furthermore, the above-described means of increasing agitation are more effective where a bleaching accelerator is used, and they sometimes provide a marked increase in the accelerating effect and eliminate the fixer inhibiting action due to the bleaching accelerator.

The automatic processors which can be used for photosensitive materials of the present invention preferably have photosensitive material transporting devices as disclosed in JP-A-60-191257, JP-A-60-191258 or JP-A-60-191259. With such a transporting device, such as that disclosed in JP-A-60-191257, carry over of processing liquid from one bath to the next is greatly reduced and this is very effective for preventing deterioration in processing bath performance. These effects are especially effective for shortening the processing time in each process and for reducing the replenishment rate of each processing bath.

The silver halide color photographic materials of this invention are generally subjected to a water washing process and/or stabilizing process after the desilvering process. The amount of wash water used in the washing process can be varied over a wide range, depending on the application and the nature (depending on materials such as couplers which have been used, for example) of the photosensitive material, the wash water temperature, the number of water washing tanks (the number of water washing stages) and the replenishment system, i.e. whether a counter flow or a sequential flow system is used, and various other conditions. The relationship between the amount of water used and the number of washing tanks in a multi-stage counter-flow system can be determined using the method outlined on pages 248–253 of the *Journal of the Society of Motion Picture and Television Engineers,* Volume 64 (May 1955).

The amount of wash water used can be greatly reduced by using the multi-stage counter-flow system noted in the above-described literature, but bacteria proliferate due to the increased residence time of the water in the tanks and problems arise because the suspended matter which is produced becomes attached to the photosensitive material. The method in which the calcium ion and magnesium ion concentrations are reduced, disclosed in JP-A-62-288838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in Horiguchi, *The Chemistry of Biocides and Fungicides* (1986, Sanko Shuppan), in *Killing Microorganisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used in this connection.

The pH of the washing water when processing photosensitive materials of the present invention is from 4 to 9, and preferably from 5 to 8. The washing water temperature and the washing time can be varied in accordance with the nature and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are used. Moreover, the photosensitive materials of this invention can be processed directly in a stabilizing bath instead of being subjected to a water wash as described above. Known methods disclosed in JP-A-57-8543, JP-A-58-14834 and JP-A-60-220345 can be used for a stabilization process of this type.

Furthermore, where a stabilization process is carried out following the aforementioned water washing process, and the stabilizing baths which contain dye stabilizing agents and surfactants which are used as final baths with camera color photosensitive materials are examples of such a process. Aldehydes such as formaldehyde and glutaraldehyde, N-methylol compounds, hexamethylenetetramine and aldehyde/bisulfite addition compounds can be used, for example, as dye stabilizing agents.

Various chelating agents and fungicides can also be present in these stabilizing baths.

The overflow which accompanies replenishment of the above described water washing or stabilizing baths can be reused in other processes, such as the de-silvering process for example.

Concentration correction with the addition of water is desirable where the above described processing baths become concentrated due to evaporation when processing in an automatic processor, for example.

Color developing agents can be incorporated into a silver halide color photosensitive material of the present invention to simplify and speed up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599, *Research Disclosure,* No. 14850 and *Research Disclosure,* No. 15159, the aldol compounds disclosed in *Research Disclosure,* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as necessary, into a silver halide color photosensitive material of the present invention to accelerate color development. Typical compounds are disclosed, for example, in JP-A-56-64339, JP-A-57-144547 and JP-A-58-115438.

The various processing baths in the present invention are used at a temperature of from 10° C. to 50° C. A standard temperature is generally from 33° C. to 38° C., but accelerated processing and shorter processing times can be achieved at higher temperatures while, on the other hand, increased picture quality and better processing bath stability can be achieved at lower temperatures.

Furthermore, the silver halide photosensitive materials of the present invention can also be used in the heat developable photosensitive materials disclosed, for example, in U.S. Pat. No. 4,500,626, JP-A-60-133449, JP-A-59-218443, JP-A-61-238056 and European Patent 210,660A2.

The invention is described in greater detail below by reference to illustrative examples, but the invention is not to be construed as being limited by these examples.

EXAMPLE 1

Preparation of Sample 101

A multi-layer color photosensitive material comprising layers of the compositions indicated below was prepared on a cellulose triacetate film support of a thickness of 127 μm on which an under-layer had been coated, and this was designated as Sample 101. The numbers indicate the amounts added per square meter. Moreover, the effect of the compounds added is not limited to the .specific functional description set forth.

| First Layer: Anti-halation Layer | |
|---|---|
| Black Colloidal Silver | 0.25 gram |
| Gelatin | 1.9 grams |
| Ultraviolet Absorber U-1 | 0.04 gram |
| Ultraviolet Absorber U-2 | 0.1 gram |
| Ultraviolet Absorber U-3 | 0.1 gram |
| Ultraviolet Absorber U-4 | 0.1 gram |
| Ultraviolet Absorber U-6 | 0.1 gram |

-continued

| | |
|---|---|
| High Boiling Point Organic Solvent Oil-1 | 0.1 gram |
| **Second Layer: Intermediate Layer** | |
| Gelatin | 0.40 gram |
| Compound Cpd-D | 10 mg |
| High Boiling Point Organic Solvent Oil-3 | 0.1 gram |
| Dye D-4 | 0.4 mg |
| **Third Layer: Intermediate Layer** | |
| Fine grained silver iodobromide emulsion of which the surface and interior had been fogged (average gain size 0.06 μm, variation coefficient 18%, AgI content 1 mol %) | 0.05 gram as silver |
| Gelatin | 0.4 gram |
| **Fourth Layer: Low Speed Red Sensitive Emulsion Layer** | |
| Emulsion A | as silver 0.2 gram |
| Emulsion B | as silver 0.3 gram |
| Gelatin | 0.8 gram |
| Coupler C-1 | 0.15 gram |
| Coupler C-2 | 0.05 gram |
| Coupler C-9 | 0.05 gram |
| Compound Cpd-D | 10 mg |
| High boiling point organic solvent Oil-2 | 0.1 gram |
| **Fifth Layer: Medium Speed Red Sensitive Emulsion Layer** | |
| Emulsion B | as silver 0.2 gram |
| Emulsion C | as silver 0.3 gram |
| Gelatin | 0.8 gram |
| Coupler C-1 | 0.2 gram |
| Coupler C-2 | 0.05 gram |
| Coupler C-3 | 0.2 gram |
| High boiling point organic solvent Oil-2 | 0.1 gram |
| **Sixth Layer: High Speed Red Sensitive Emulsion Layer** | |
| Emulsion D | as silver 0.4 gram |
| Gelatin | 1.1 grams |
| Coupler C-1 | 0.3 gram |
| Coupler C-3 | 0.7 Gram |
| Additive P-1 | 0.1 gram |
| **Seventh Layer: Intermediate Layer** | |
| Gelatin | 0.6 gram |
| Compound M-1 | 0.3 gram |
| Anti-color mixing agent Cpd-K | 2.6 mg |
| Ultraviolet absorber U-1 | 0.1 gram |
| Ultraviolet absorber U-6 | 0.1 gram |
| Dye D-1 | 0.02 gram |
| **Eighth Layer: Intermediate Layer** | |
| A fine grained silver iodobromide emulsion of which the surface and interior had been fogged (average gain size 0.06 μm, variation coefficient 16%, AgI content 0.3 mol %) | 0.02 gram as silver |
| Gelatin | 1.0 gram |
| Additive P-1 | 0.2 gram |
| Anti-Color Mixing Agent Cpd-J | 0.1 gram |
| Anti-Color Mixing Agent Cpd-A | 0.1 gram |
| **Ninth Layer: Low Speed Green Sensitive Emulsion Layer** | |
| Emulsion E | as silver 0.3 gram |
| Emulsion F | as silver 0.1 gram |
| Emulsion G | as silver 0.1 gram |
| Gelatin | 0.5 gram |
| Coupler C-7 | 0.05 gram |
| Coupler C-4 | 0.20 gram |
| Compound Cpd-B | 0.03 gram |
| Compound Cpd-D | 10 mg |
| Compound Cpd-E | 0.02 gram |
| Compound Cpd-F | 0.02 gram |
| Compound Cpd-G | 0.02 gram |
| Compound Cpd-H | 0.02 gram |
| High Boiling Point Organic Solvent Oil-1 | 0.1 gram |
| High Boiling Point Organic Solvent Oil-2 | 0.1 gram |
| **Tenth Layer: Medium Speed Green Sensitive Emulsion Layer** | |
| Emulsion G | as silver 0.3 gram |
| Emulsion H | as silver 0.1 gram |
| Gelatin | 0.6 gram |
| Coupler C-7 | 0.2 gram |
| Coupler C-4 | 0.1 gram |
| Compound Cpd-B | 0.03 gram |
| Compound Cpd-E | 0.02 gram |
| Compound Cpd-F | 0.02 gram |
| Compound Cpd-G | 0.05 gram |
| Compound Cpd-H | 0.05 gram |
| High Boiling Point Organic Solvent Oil-2 | 0.01 gram |
| **Eleventh Layer: High Speed Green Sensitive Emulsion Layer** | |
| Emulsion I | as silver 0.5 gram |
| Gelatin | 1.0 gram |
| Coupler C-4 | 0.3 gram |
| Coupler C-8 | 0.1 gram |
| Compound Cpd-B | 0.08 gram |
| Compound Cpd-E | 0.02 gram |
| Compound Cpd-F | 0.02 gram |
| Compound Cpd-G | 0.02 gram |
| Compound Cpd-H | 0.02 gram |
| High Boiling Point Organic Solvent Oil-1 | 0.02 gram |
| High Boiling Point Organic Solvent Oil-2 | 0.02 gram |
| **Twelfth Layer: Intermediate Layer** | |
| Gelatin | 0.6 gram |
| Dye D-1 | 0.1 gram |
| Dye D-2 | 0.05 gram |
| Dye D-3 | 0.07 gram |
| **Thirteenth Layer: Yellow Filter Layer** | |
| Yellow Colloidal Siver | as silver 0.1 gram |
| Gelatin | 1.1 gram |
| Anti-Color Mixing Agent Cpd-A | 0.1 gram |
| High Boiling Point Organic Solvent Oil-1 | 0.1 gram |
| **Fourteenth Layer: Intermediate Layer** | |
| Gelatin | 0.6 gram |
| **Fifteenth Layer: Low Speed Blue Sensitive Emulsion Layer** | |
| Emulsion J | as silver 0.4 gram |
| Emulsion K | as silver 0.1 gram |
| Emulsion L | as silver 0.1 gram |
| Gelatin | 0.8 gram |
| Coupler C-5 | 0.6 gram |
| **Sixteenth Layer: Medium Speed Blue Sensitive Emulsion Layer** | |
| Emulsion L | as silver 0.1 gram |
| Emulsion M | as silver 0.4 gram |
| Gelatin | 0.9 gram |
| Coupler C-5 | 0.3 gram |
| Coupler C-6 | 0.3 gram |
| **Seventeenth Layer: High Speed Blue Sensitive Emulsion Layer** | |
| Emulsion N | as silver 0.4 gram |
| Gelatin | 1.2 grams |
| Coupler C-6 | 0.7 gram |
| **Eighteenth Layer: First Protective Layer** | |
| Gelatin | 0.7 gram |
| Ultraviolet Absorber U-1 | 0.04 gram |
| Ultraviolet Absorber U-2 | 0.01 gram |
| Ultraviolet Absorber U-3 | 0.03 gram |
| Ultraviolet Absorber U-4 | 0.03 gram |
| Ultraviolet Absorber U-5 | 0.05 gram |
| Ultraviolet Absorber U-6 | 0.05 gram |
| High Boiling Point Organic Solvent Oil-1 | 0.02 gram |
| **Formaldehyde Scavengers** | |
| Cpd-C | 0.2 gram |
| Cpd-1 | 0.4 gram |
| Dye D-3 | 0.05 gram |
| **Nineteenth Layer: Second Protective Layer** | |
| Colloidal silver | as silver 0.1 mg |
| Fine grained silver iodobromide emulsion (average grain size 0.06 μm, AgI Content 1 mol %) | 0.1 gram as silver |
| Gelatin | 0.4 gram |

-continued

| Twentieth Layer: Third Protective Layer | |
|---|---|
| Gelatin | 0.4 gram |
| Poly(methyl methacrylate) (average Particle size 1.5 μm) | 0.1 gram |
| Methyl Methacrylate/Acrylic Acid (4:6) Copolymer (average particle size 1.5 μm) | 0.1 gram |
| Silicone Oil | 0.03 gram |
| Surfactant W-1 | 3.0 mg |
| Surfactant W-2 | 0.03 gram |

Furthermore, Additives F-1 to F-8 were added to all of the emulsion layers in addition to the components shown above. Moreover, Gelatin Hardening Agent H-1 and Surfactants W-3 and W-4 for coating purposes and emulsification purposes were added to each layer in addition to the components shown above.

Moreover, phenol, 1,2-benzisothiazolin-3-one, 2-phenoxyethanol and phenethyl alcohol were added as biocides and fungicides.

The silver iodobromide emulsions used are indicated below.

| Emulsion | | Average Grain Size (μm) | Variation Coefficient (%) | AgI Content (%) |
|---|---|---|---|---|
| A | Mono-disperse tetradecahedral grains | 0.25 | 16 | 3.7 |
| B | Mono-disperse cubic internal latent image type grains | 0.30 | 10 | 3.3 |
| C | Mono-disperse tetradecahedral grains | 0.30 | 18 | 5.0 |
| D | Poly-disperse twinned crystal grains | 0.60 | 25 | 2.0 |
| E | Mono-disperse cubic grains | 0.17 | 17 | 4.0 |
| F | Mono-disperse cubic grains | 0.20 | 16 | 4.0 |
| G | Mono-disperse cubic internal latent image type grains | 0.25 | 11 | 3.5 |
| H | Mono-disperse cubic internal latent image type grains | 0.30 | 9 | 3.5 |
| I | Poly-disperse tabular grains, average aspect ratio 4.0 | 0.80 | 28 | 1.5 |
| J | Mono-disperse tetradecahedral grains | 0.30 | 18 | 4.0 |
| K | Mono-disperse tetradecahedral grains | 0.37 | 17 | 4.0 |
| L | Mono-disperse cubic internal latent image type grains | 0.46 | 14 | 3.5 |
| M | Mono-disperse cubic grains | 0.55 | 13 | 4.0 |
| N | Poly-disperse tabular grains, average aspect ratio 7.0 | 1.00 | 33 | 1.3 |

Spectral Sensitization of Emulsions A to N

| Emulsion | Sensitizing Dye Added | Amount Added per Mol Silver Halide | Time At Which Sensitizing Dye Was Added |
|---|---|---|---|
| A | S-1 | 0.025 | Immediately after chemical sensitization |
| | S-2 | 0.25 | Immediately after chemical sensitization |
| B | S-1 | 0.01 | Immediately after the end of grain formation |
| | S-2 | 0.25 | Immediately after the end of grain formation |
| C | S-1 | 0.02 | Immediately after chemical sensitization |
| | S-2 | 0.25 | Immediately after chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after the end of grain formation |
| | S-4 | 0.08 | Immediately after the end of grain formation |
| H | S-3 | 0.2 | During grain formation |
| | S-4 | 0.06 | During grain formation |
| I | S-3 | 0.3 | Immediately before start of chemical sensitization |
| | S-4 | 0.07 | Immediately before start of chemical sensitization |
| | S-8 | 0.1 | Immediately before start of chemical sensitization |
| J | S-6 | 0.2 | During grain formation |
| | S-5 | 0.05 | During grain formation |
| K | S-6 | 0.2 | During grain formation |
| | S-5 | 0.05 | During grain formation |
| L | S-6 | 0.22 | Immediately after the end of grain formation |
| | S-5 | 0.06 | Immediately after the end of grain formation |
| M | S-6 | 0.15 | Immediately after chemical sensitization |
| | S-5 | 0.04 | Immediately after chemical sensitization |
| N | S-6 | 0.22 | Immediately after the end of grain formation |
| | S-5 | 0.06 | Immediately after the end of grain formation |

C-1
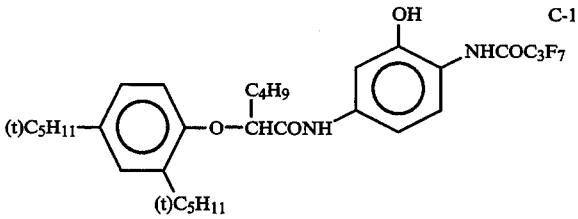
C-2
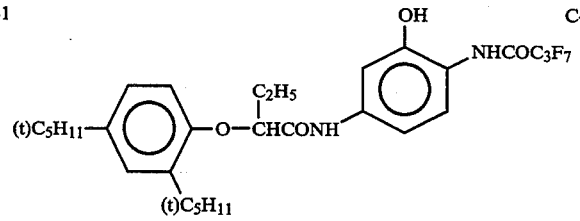
C-3
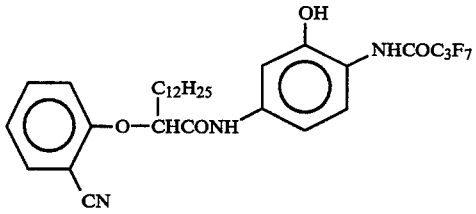
C-4
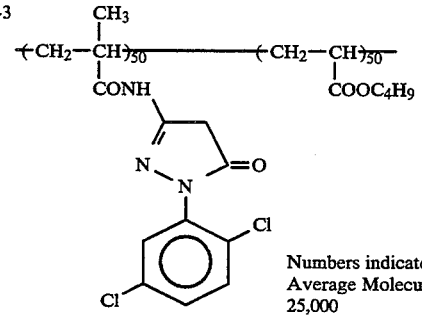
Numbers indicate wt %
Average Molecular Weight: About 25,000
C-5
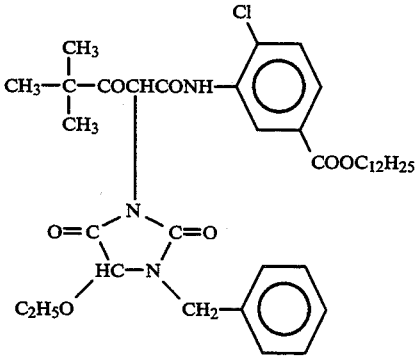
C-6
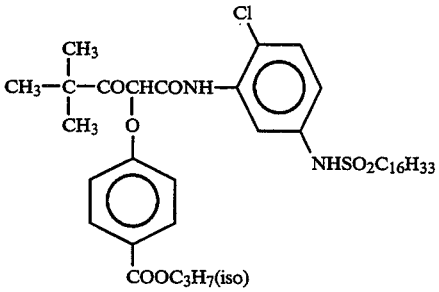
C-7
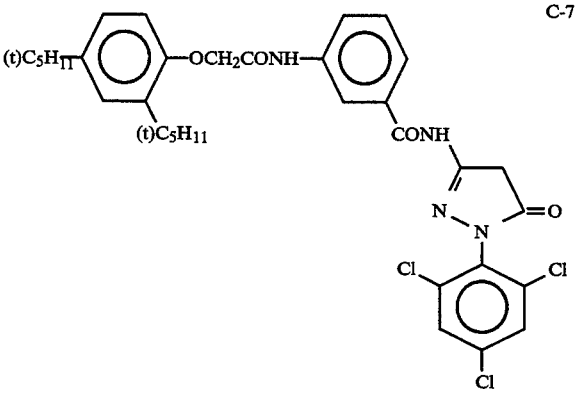
C-9
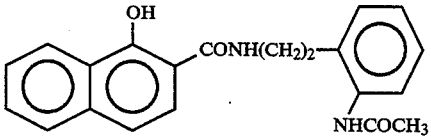
Dibutyl phthalate Oil-1
Tricresyl phosphate Oil-2
Oil-3
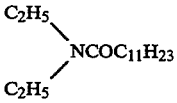
Cpd-A
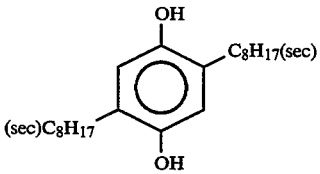
Cpd-B
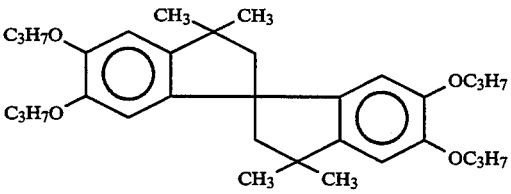
Cpd-C
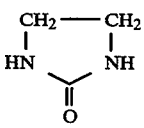

-continued
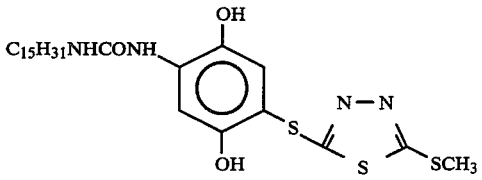
Cpd-D
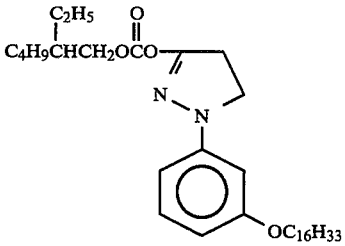
Cpd-E
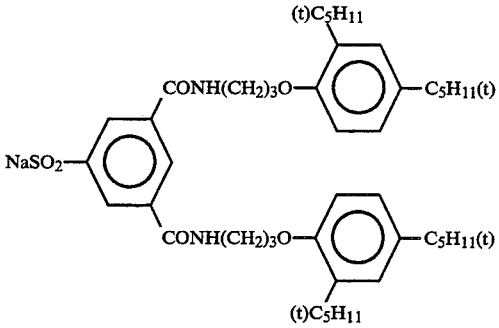
Cpd-F
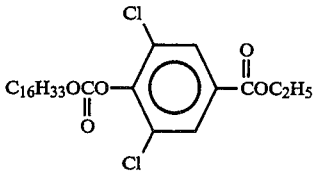
Cpd-G
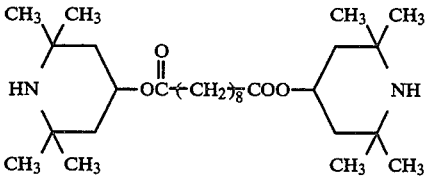
Cpd-H
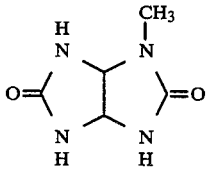
Cpd-I
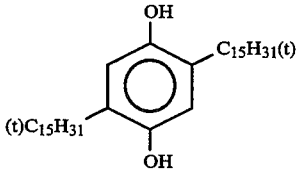
Cpd-J
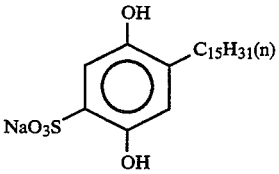
Cpd-K
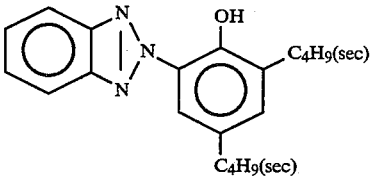
U-1
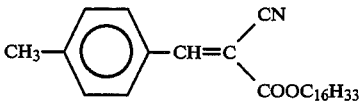
U-2
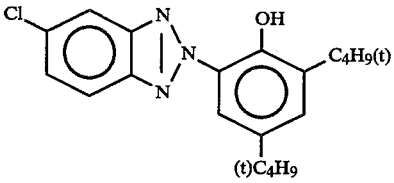
U-3
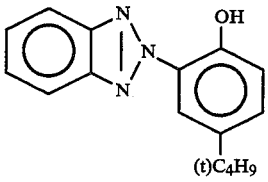
U-4
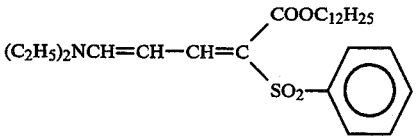
U-5
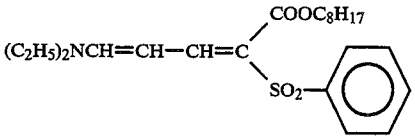
U-6

-continued
S-1
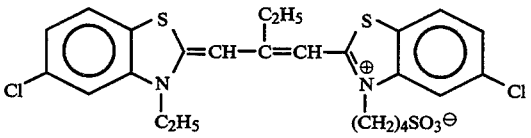
S-2
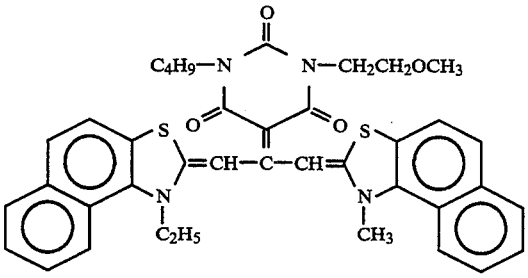
S-3
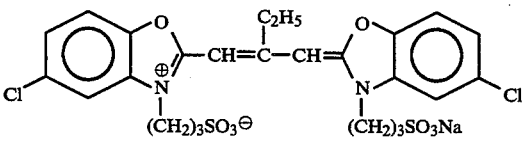
S-4
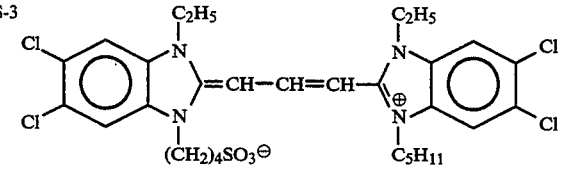
S-5
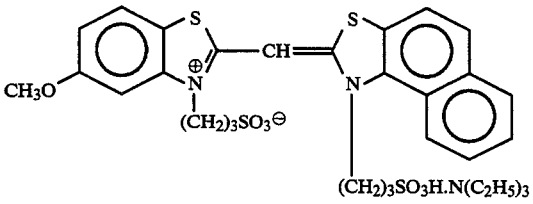
S-6
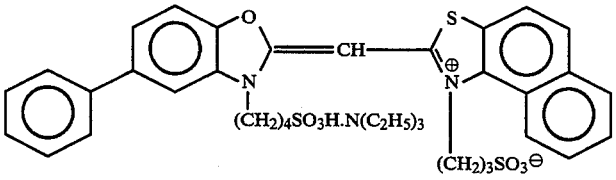
S-7
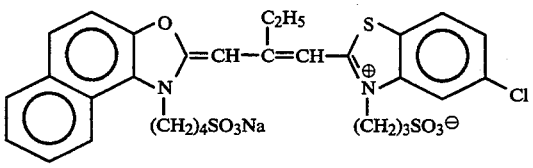
S-8
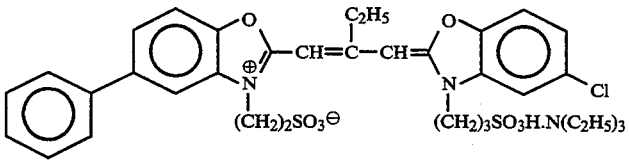
D-1
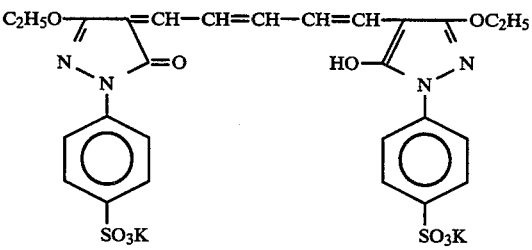
D-2
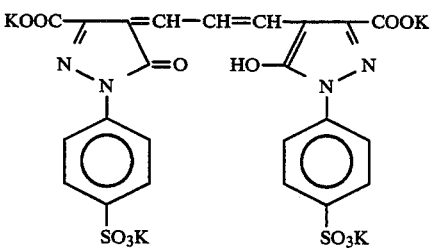

-continued
D-3
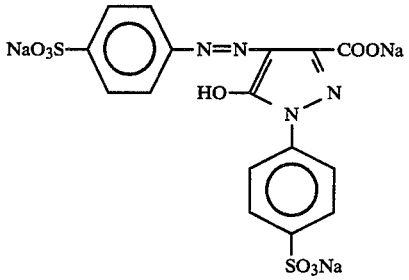
D-4
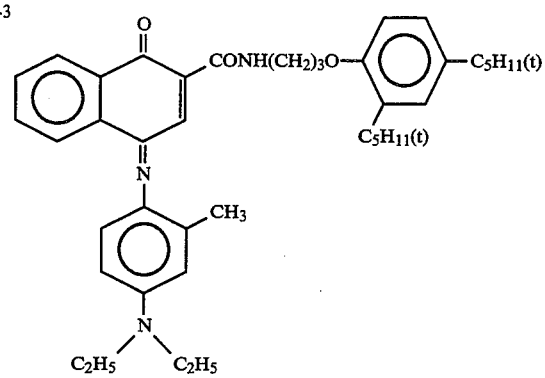
H-1
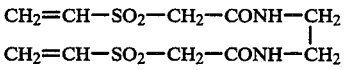
W-1
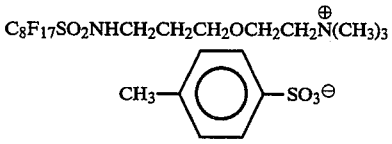
W-2
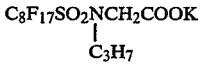
W-3
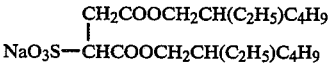
W-4
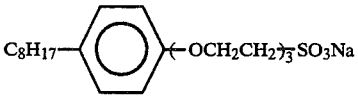
P-1
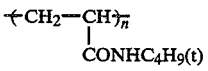
M-1
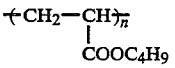
F-1
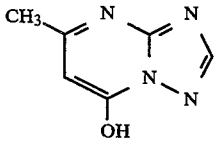
F-2
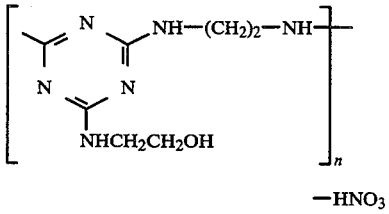
F-3
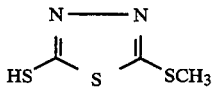
F-4
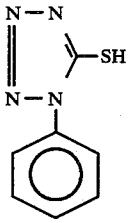
F-5
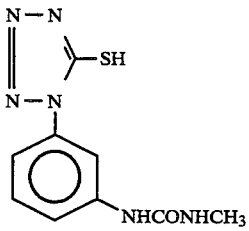
F-6
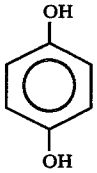
F-7
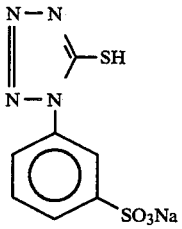

-continued

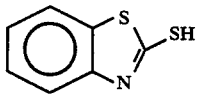

F-8

Preparation of Samples 102–106

These samples were prepared in the same way as Sample 101 except that the total number of mol of Couplers C-7 and C-4 added to the ninth, tenth and eleventh layers in Sample 101 was replaced with an equimolar amount of Coupler (1), (2), (6) or (10) of the present invention or comparative Coupler A respectively.

Samples 101 to 106 so obtained were subjected to a conventional wedge exposure, after which they were developed and processed in accordance with the development processes A and B respectively described below.

The light fastness of the developed samples obtained was evaluated by illumination for 5 days in a xenon fading tester (100,000 lux). Then, the increase in the yellow $D_{min}$ value after storage in the dark for 9 days at 100° C. was evaluated.

Furthermore, the above described samples were cut to a width of 35 mm and finished and then used to photograph a color chart made by the MacBeth Company and the red color reproduction was assessed visually.

The results obtained are shown in Table 1 below. The samples of this present invention clearly gave a highly saturated red coloration and exhibited a marked increase in light fastness. Furthermore, the increase in the yellow $D_{min}$ on storage in the dark was very small with the oxygen atom elimination and nitrogen atom elimination couplers, and these were especially good.

Each samples obtained in the development processes A and B shows good results in the same level.

COMPARATIVE COUPLER A

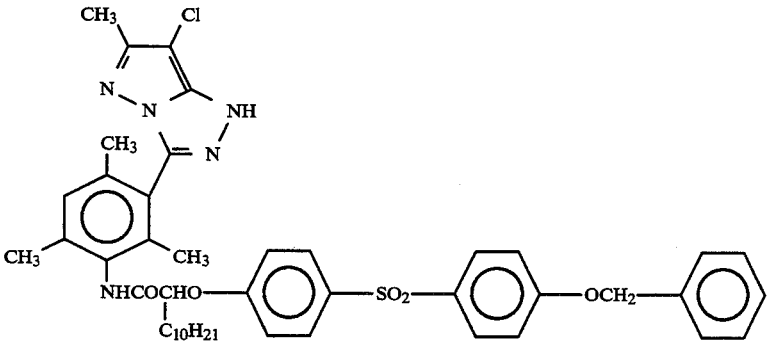

(Compound Disclosed in U.S. Pat. No. 4,942,117)

| Processing Operation (A) | Time (min) | Temp. (°C.) | Tank Capacity (liters) | Replenishment Rate (l/m²) |
|---|---|---|---|---|
| Black & White Development | 6 | 38 | 12 | 2.2 |
| First Water Wash | 2 | 38 | 4 | 7.5 |
| Reversal | 2 | 38 | 4 | 1.1 |
| Color Development | 6 | 38 | 12 | 2.2 |
| Bleaching | 3 | 38 | 6 | 0.15 |
| Fixing | 4 | 38 | 8 | 2.2 |
| Second Water Wash (1) | 2 | 38 | 4 | — |
| Second Water Wash (2) | 2 | 38 | 4 | 7.5 |
| Stabilization | 2 | 38 | 4 | 1.1 |

-continued

| Processing Operation (A) | Time (min) | Temp. (°C.) | Tank Capacity (liters) | Replenishment Rate (l/m²) |
|---|---|---|---|---|
| Third Water Wash | 1 | 38 | 4 | 1.1 |

The overflow from the second water wash (2) bath was fed into the second water wash (1) bath.

| Black and White Developer | Parent Bath | Replenisher |
|---|---|---|
| Nitrilo-N,N,N-trimethylene-phosphonic Acid, penta-sodium salt | 2.0 grams | 2.0 grams |
| Diethylenetriamine Pentaacetic Acid, penta-sodium salt | 3.0 grams | 3.0 grams |
| Potassium Sulfite | 30.0 grams | 30.0 grams |
| Hydroquinone Monosulfonic Acid, potassium salt | 20.0 grams | 20.0 grams |
| Potassium Carbonate | 33.0 grams | 33.0 grams |
| 1-Phenyl-4-methyl-4-hydroxy-methyl-3-pyrazolidone | 2.0 grams | 2.0 grams |
| Potassium Bromide | 2.5 grams | 1.4 grams |
| Potassium Thiocyanate | 1.2 grams | 1.2 grams |
| Potassium Iodide | 2.0 grams | 2.0 mg |
| Water to make | 1.0 liter | 1.0 liter |
| pH (25° C.) | 9.60 | 9.70 |

The pH was adjusted with hydrochloric acid or potassium hydroxide

| Reversal Bath | Parent Bath | Replenisher |
|---|---|---|
| Nitrilo-N,N.N-trimethylene-phosphonic Acid, penta-sodium salt | 3.0 grams | Same as Parent Bath |
| Stannous Chloride, di-hydrate | 1.0 gram | |
| p-Aminophenol | 0.1 gram | |
| Sodium Hydroxide | 8.0 grams | |
| Glacial Acetic Acid | 15.0 ml | |
| Water to make | 1.0 liter | |
| pH (25° C.) | 6.00 | |

The pH was adjusted with hydrochloric acid or sodium hydroxide.

| Color Developer | Parent Bath | Replenisher |
|---|---|---|
| Nitrilo-N,N,N-trimethylene-phosphonic Acid, penta-sodium salt | 2.0 grams | 2.0 grams |
| Diethylenetriamine Pentaacetic Acid, penta-sodium salt | 2.0 grams | 2.0 grams |
| Sodium Sulfite | 7.0 grams | 7.0 grams |
| Tri-potassium Phosphate, dodeca-hydrate | 36.0 grams | 36.0 grams |
| Potassium Bromide | 2.0 gram | — |
| Potassium Iodide | 90.0 mg | — |
| Sodium Hydroxide | 3.0 grams | 3.0 grams |
| Citrazinic Acid | 1.5 grams | 1.5 grams |
| N-Ethyl-(β-methanesulfon-amidoethyl)-3-methyl-4-aminoaniline Sulfate | 10.5 grams | 10.5 grams |
| 3,6-Dithiaoctane-1,8-diol | 3.5 grams | 3.5 grams |
| Water to make | 1.0 liter | 1.0 liter |
| pH (25° C.) | 11.90 | 12.05 |

The pH was adjusted with hydrochloric acid or potassium hydroxide.

| Bleach | Parent Bath | Replenisher |
|---|---|---|
| 1,3-Diaminopropane Tetraacetic Acid | 2.8 grams | 4.0 grams |
| 1,3-Diaminopropane Tetraacetic Acid, ferric ammonium salt, mono-hydrate | 138.0 grams | 207.0 grams |
| Ammonium Bromide | 80.0 grams | 120.0 grams |
| Ammonium Nitrate | 20.0 grams | 30.0 grams |
| Hydroxyacetic Acid | 50.0 grams | 75.0 grams |
| Acetic Acid | 50.0 grams | 75.0 grams |
| Water to make | 1.0 liter | 1.0 liter |
| pH (25° C.) | 3.40 | 2.80 |

The pH was adjusted with acetic acid or aqueous ammonia.

| Fixer | Parent Bath | Replenisher |
|---|---|---|
| Ethylenediamine Tetra-acetic Acid, di-sodium salt, di-hydrate | 1.7 grams | Same as the Parent Bath |
| Benzaldehyde-o-sulfonic Acid, sodium salt | 20.0 grams | |
| Sodium Bisulfite | 15.0 grams | |
| Ammonium Thiosulfate (700 g/l) | 340.0 ml | |
| Imidazole | 28.0 grams | |
| Water to make | 1.0 liter | |
| pH (25° C.) | 4.00 | |

The pH was adjusted with acetic acid or aqueous ammonia.

| Stabilizer | Parent Bath | Replenisher |
|---|---|---|
| Ethylenediamine Tetra-acetic Acid, di-sodium salt, di-hydrate | 1.0 gram | Same as Parent Bath |

-continued

| Stabilizer | Parent Bath | Replenisher |
|---|---|---|
| Sodium Carbonate | 6.0 gram | |
| Formaldehyde (37%) | 5.0 ml | |
| Water to make | 1.0 liter | |
| pH (25° C.) | 10.00 | |

The pH was adjusted with acetic acid or sodium hydroxide.

| Third Water Wash Bath | Parent Bath | Replenisher |
|---|---|---|
| Ethylenediamine Tetra-acetic Acid, di-sodium salt, di-hydrate | 0.2 gram | Same as the Parent Bath |
| Hydroxyethylidene-1,1-Disulfonic Acid | 0.05 gram | |
| Ammonium Acetate | 2.0 grams | |
| Sodium Dodecylbenzene-sulfonate | 0.3 gram | |
| pH (25° C.) | 4.50 | |

The pH was adjusted with acetic acid or aqueous ammonia.

(Process B) was the same as (Process A) except that the stabilizer in (Process A) was as shown below.

| Stabilizer | Parent Bath | Replenisher |
|---|---|---|
| Ethylenediamine Tetra-acetic Acid, di-sodium salt, di-hydrate | 1.0 gram | Same as the Parent Bath |
| Sodium Carbonate | 6.0 grams | |
| Dimethylol Urea | 8.0 grams | |
| Water to make | 1.0 liter | |
| pH (25° C.) | 10.00 | |

The pH was adjusted with acetic acid or sodium hydroxide.

TABLE 1

| Sample Number | Coupler in Layers 9–11 | Light Fastness[1] | Reproduction of Red | Yellow Staining on Dark Storage[2] |
|---|---|---|---|---|
| 101 (Comp. Ex.) | C-7/C-4 | 68% | Control | 0.30 |
| 102 (This Invention) | (1) | 76% | High Saturation | 0.28 |
| 103 (This Invention) | (2) | 76% | High Saturation | 0.29 |
| 104 (This Invention) | (6) | 72% | High Saturation | 0.01 |
| 104 (This Invention) | (10) | 70% | High Saturation | 0.01 |
| 106 (Comp. Ex.) | Comparative Coupler A | 42% | High Saturation | 0.30 |

EXAMPLE 2

Samples 201 to 205 were prepared by replacing the total number of mol of Couplers ExM-1 and ExM-2 in the sixth and seventh layers in Example 2 of JP-A-1-158431 with equimolar amounts of comparative Coupler A and Couplers (1), (2), (6) and (10) of the present invention.

These samples were processed in the way described in JP-A-1-158431 and light fastness tests were carried out using a xenon color fading tester.

Results similar to those obtained in Example 1 were obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer and containing a 1H-pyrazolo[5,1-c]-1,2,4-triazole coupler represented by formula (I-11):

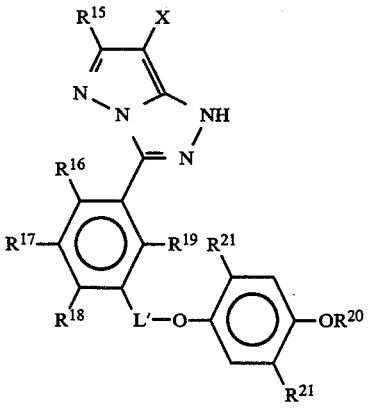

(I-11)

wherein $R^{20}$ represents an aryl group or an alkyl group which has 20 carbon atoms or less; $R^{21}$ represents a hydrogen atom or an alkyl group; $R^{15}$, $R^{16}$, $R^{17}$, $R^{18}$ and $R^{19}$ which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; L' represents a divalent linking group which has at least 1 carbon atoms; and X represents a substituent which is eliminated after a coupling reaction with an oxidation product of a primary aromatic amine developing agent.

2. The silver halide color photographic material of claim 1, wherein X is a group which is linked via an oxygen atom or a nitrogen atom.

3. The silver halide color photographic material of claim 1, wherein the silver halide color photographic material contains from 0.1 to 2 mmol of a coupler represented by formula (I-11).

* * * * *